US012618237B2

(12) United States Patent
Rivas et al.

(10) Patent No.: US 12,618,237 B2
(45) **Date of Patent: *May 5, 2026**

(54) CEILING FAÇADE SYSTEM

(71) Applicant: Cover Technologies, Inc., Gardena, CA (US)

(72) Inventors: Alexis Xavier Rivas, Gardena, CA (US); Jemuel Joseph, Gardena, CA (US); Thomas Heyer, Gardena, CA (US); Craig Derian, Gardena, CA (US); Katherine Stavisky, Gardena, CA (US); Robert Jackson, Gardena, CA (US); Scott Kevern, Gardena, CA (US); Tyler Peterson, Gardena, CA (US); Jose Morales, Gardena, CA (US)

(73) Assignee: Cover Technologies, Inc., Gardena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/657,696

(22) Filed: May 7, 2024

(65) Prior Publication Data

US 2024/0360669 A1 Oct. 31, 2024

Related U.S. Application Data

(63) Continuation of application No. 18/131,699, filed on Apr. 6, 2023, now Pat. No. 12,018,485, which is a (Continued)

(51) Int. Cl.
*E04B 9/04* (2006.01)
*E04B 9/00* (2006.01)

(52) U.S. Cl.
CPC ..... *E04B 9/04* (2013.01); *E04B 9/001* (2013.01); *E04B 9/003* (2013.01)

(58) Field of Classification Search
CPC . E04B 9/04; E04B 9/003; E04B 9/001; E04B 9/02; E04B 9/0428; E04B 9/0435; E04B 9/0478; E04B 9/241; E04B 9/006
See application file for complete search history.

(56) References Cited

U.S. PATENT DOCUMENTS 3,143,637 A * 8/1964 Turner ..... F24D 13/024 392/435
4,205,719 A * 6/1980 Norell ..... E04C 2/525 165/49

(Continued)

*Primary Examiner* — Patrick J Maestri
(74) *Attorney, Agent, or Firm* — Run8 Patent Group, LLC; Peter Miller; Marissa Kohrman

(57) ABSTRACT

A ceiling façade system includes: a ceiling tile including an interior panel defining a first edge extending along a first side of the ceiling tile and a second edge extending along a second side of the ceiling tile opposite the first edge, a heating element, and an insulator layer arranged over the heating element opposite the interior panel; a first receiver extending along and configured to support the first side of the ceiling tile on a linear lighting track arranged on a ceiling structure and configured to locate the first edge of the interior panel adjacent and partially concealing the linear lighting track; and a second receiver extending along and configured to support the second side of the ceiling tile on a linear seam track arranged on the ceiling structure, the linear seam track laterally offset from the linear lighting track.

21 Claims, 7 Drawing Sheets

Related U.S. Application Data continuation of application No. 17/557,922, filed on Dec. 21, 2021, now Pat. No. 11,649,629, which is a continuation of application No. 17/121,530, filed on Dec. 14, 2020, now Pat. No. 11,365,541.

(60) Provisional application No. 62/948,036, filed on Dec. 13, 2019.

(56) References Cited

U.S. PATENT DOCUMENTS

2006/0262521 A1* 11/2006 Piepgras ..... F21V 29/70
362/404
2017/0362829 A1* 12/2017 Satterfield ..... E04B 9/247

* cited by examiner

CEILING FAÇADE SYSTEM

CROSS-REFERENCE TO RELATED APPLICATIONS

This Application is a continuation of U.S. Non-Provisional patent application Ser. No. 18/131,699, filed on 6 Apr. 2023, which is a continuation of U.S. Non-Provisional patent application Ser. No. 17/557,922, filed on 21 Dec. 2021, which is a continuation of U.S. Non-Provisional patent application Ser. No. 17/121,530, filed on 14 Dec. 2020, which claims the benefit of U.S. Provisional Application No. 62/948,036, filed on 13 Dec. 2019, which is incorporated in its entirety by this reference.

This Application is related to U.S. patent application Ser. No. 16/875,079, filed on 15 May 2020, which is incorporated in its entirety by this reference.

TECHNICAL FIELD

This invention relates generally to the field of prefabricated building systems and more specifically to a new and useful ceiling façade system in the field of prefabricated building systems.

DESCRIPTION OF THE EMBODIMENTS

The following description of embodiments of the invention is not intended to limit the invention to these embodiments but rather to enable a person skilled in the art to make and use this invention. Variations, configurations, implementations, example implementations, and examples described herein are optional and are not exclusive to the variations, configurations, implementations, example implementations, and examples they describe. The invention described herein can include any and all permutations of these variations, configurations, implementations, example implementations, and examples.

1. Ceiling Façade System

Figure 1:
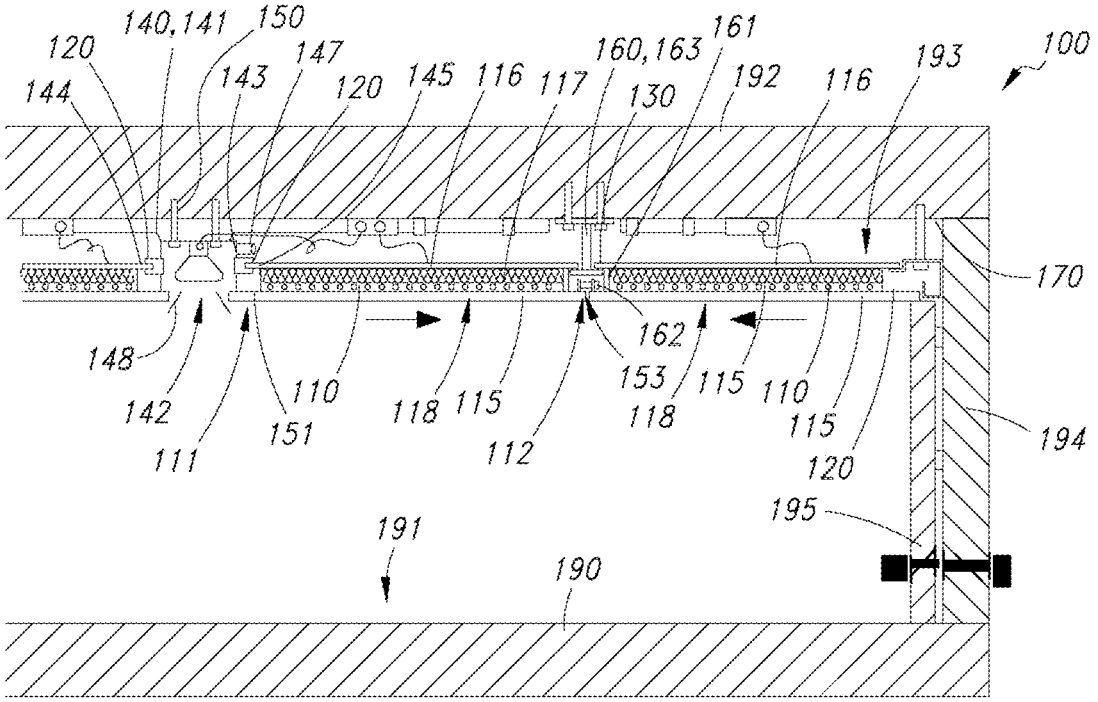
FIG. 1 is a schematic representation of a ceiling façade system.
Figure 2:
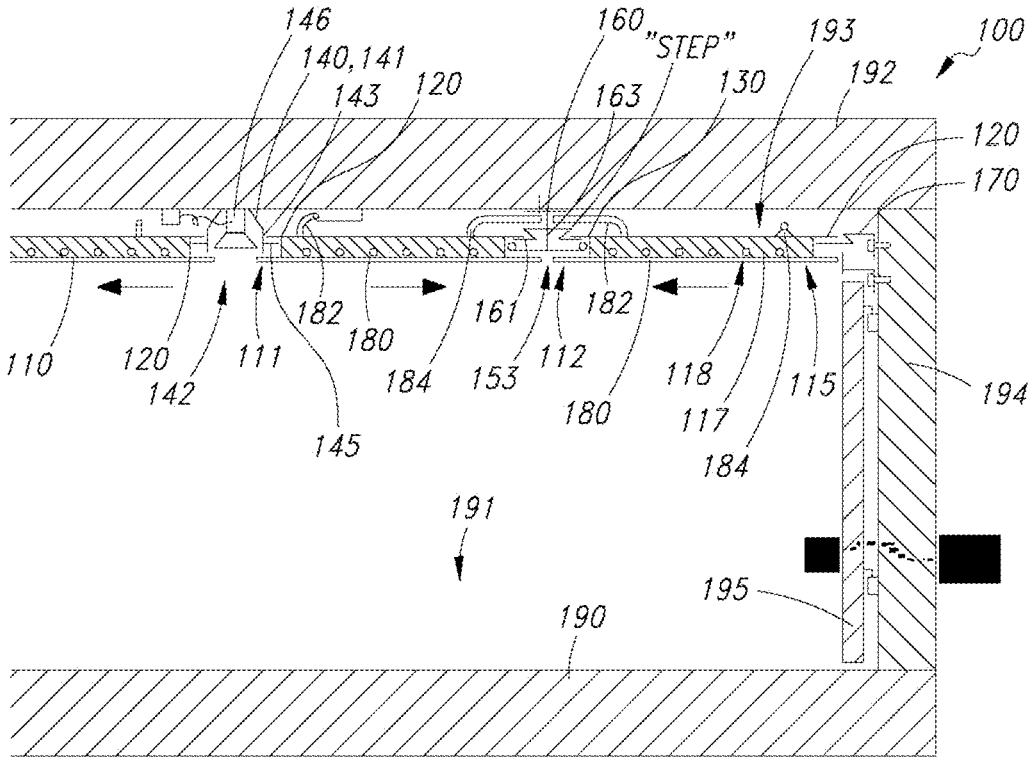
FIG. 2 is a schematic representation of one variation of the ceiling façade system.
Figure 6A:
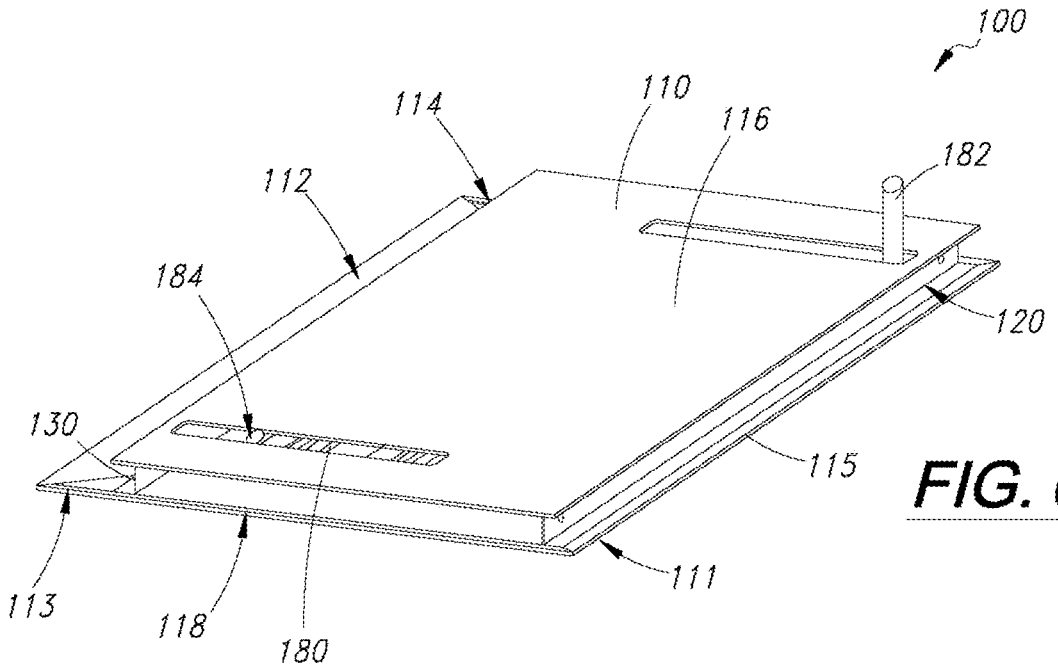
FIGS. 6A and 6B are schematic representations of one variation of the ceiling façade system.

As shown in FIGS. 1, 2 and 6A, a ceiling façade system 100 includes a first ceiling tile 110, which includes: an interior panel 115 defining an outer face 118, an inner face, a first edge extending along a first side 111 of the first ceiling tile 110, and a second edge extending along a second side 112 of the first ceiling tile 110 opposite the first edge; a heating element 180 arranged across the inner face of the interior panel 115; an insulator layer 117 arranged over the heating element 180 opposite the interior panel 115; and a rear panel 116 arranged over the insulator layer 117 opposite the interior panel 115. The ceiling façade system 100 also includes a first receiver 120: extending along the first side 111 of the first ceiling tile 110; configured to support the first side 111 of the first ceiling tile 110 on a first locating feature 145 of a linear lighting track 140 arranged on a ceiling structure 192; and configured to locate the first edge of the interior panel 115 of the first ceiling tile 110 adjacent and concealing the first locating feature 145 of the linear lighting track 140. The ceiling structure 192 further includes a second receiver 130: extending along the second side 112 of the first ceiling tile 110; and configured to support the second side 112 of the first ceiling tile 110 on a second locating feature 161 of a linear seam track 160 arranged on the ceiling structure 192, the linear seam track 160 laterally offset from the linear lighting track 140.

One variation of the ceiling façade system 100 shown in FIGS. 1 and 2 includes a first linear lighting track 140, which includes: a body 141 defining a lighting cavity 142 configured to face downwardly from a ceiling structure 192; a light socket 146 arranged in the lighting cavity 142 and configured to receive a light element; and a first locating feature 145 extending laterally from the body 141 opposite the lighting cavity 142 and located along a first length of the first linear lighting track 140. In this variation, the ceiling façade system 100 also includes a linear seam track 160: including a second locating feature 161 extending laterally toward the first locating feature 145 and located along a second length of the linear seam track 160; and configured to locate on the ceiling structure 192 laterally offset from the linear light track. In this variation, the ceiling façade system 100 further includes a first set of ceiling tiles 110, each including: an interior panel 115 defining an outer face 118, an inner face, a first edge extending along a first side 111 of the ceiling tile 110, and a second edge extending along a second side 112 of the ceiling tile 110 opposite the first edge; a rear panel 116; an insulator layer 117 arranged between the interior panel 115 and the rear panel 116; a first receiver 120 extending along a first side 111 of the ceiling tile 110, configured to support the first side 111 of the ceiling tile 110 on the first locating feature 145 of the first linear lighting track 140 and configured to locate the first edge of the interior panel 115 of the ceiling tile 110 adjacent and concealing the first locating feature 145 of the first linear lighting track 140; and a second receiver 130 extending along a second side 112 of the ceiling tile 110 and configured to support the second side 112 of the ceiling tile 110 on the second locating feature 161 of the linear seam track 160.

2. Applications

Generally, the ceiling façade system 100 is configured to install on a ceiling structure 192 of a building 190 (e.g., an industrial building, an office building, a residential structure) to form grid arrays of ceiling tiles 110 interposed between integrated linear lighting tracks 140 that cooperate to define an overhead ceiling surface within integrated lighting, heating, cooling, ventilation, fire detection, and/or fire suppression services.

In particular, the ceiling façade system 100 includes linear lighting tracks 140: that define both lighting receptacles and locating features that support and locate ceiling tiles 110; and are configured to mount directly to a ceiling structure 192 (e.g., with quick-connects to service receptacles on the ceiling structure 192). The ceiling façade system 100 also includes linear seam tracks 160: that can be installed between and parallel to linear lighting tracks 140 in order to reduce lighting density; that include locating features that support and locate ceiling tiles 110; and that are concealed by ceiling tiles 110. The ceiling façade system 100 further includes ceiling tiles 110: configured to mount directly between two linear lighting tracks 140, two linear seam tracks 160, or a linear lighting and seam track pair without fasteners, clips, clamps, or other small components; that define a finished ceiling surface; that cooperate to conceal linear seam tracks 160; and that define finished edges that conceal unfinished edges of linear lighting tracks 140 (or that trim finished edges of linear lighting tracks 140) to frame lighting and ventilation elements housed in these linear lighting tracks 140.

For example, each linear lighting track 140 can include: integrated locating features configured to support and align a row of ceiling tiles 110; a light socket 146 or integrated light element; an integrated forced air vent and baffle 148; a suite of integrated sensors (e.g., temperature, humidity, lighting, and smoke sensors); and an integrated sprinkler system. In this example, each linear lighting track 140 can also be mounted directly to the ceiling structure 192 and can include integrated adjustment features that enable rapid vertical repositioning of the linear lighting track 140 on the ceiling structure 192, thereby enabling rapid leveling of ceiling tiles 110 supported between the linear lighting track 140 and an adjacent linear lighting track 140 or linear seam track 160. Each linear lighting track 140 can further include: a single electrical connector (e.g., a "plug") for all electrical systems (or single electrical connected for all light elements and a single, separate electrical connector for all integrated sensors) configured to connect to an electrical receptacle on the ceiling structure 192; a single forced air ventilation connector (e.g., a flexible duct) configured to connect to a forced air manifold on the ceiling structure 192; and a single water connection (e.g., a quick-connect water line) configured to connect to a sprinkler manifold on the ceiling structure 192. Therefore: the linear lighting track 140 can be quickly fastened to the ceiling structure 192 with minimal attention paid to vertical alignment (e.g., flatness and level) of the linear lighting track 140; and the electrical, ventilation, and sprinkler systems in the linear lighting track 140 can be connected to their corresponding receptacles and manifolds on the ceiling structure 192 with quick, single-action (e.g., "plug and play") connections.

In this example, each linear seam track 160 can be similarly fastened directly to the ceiling structure 192, such as to known flat and level datums on the ceiling structure 192. Alternatively, each linear seam track 160 can be integrated directly into the ceiling structure 192 during assembly of the building 190. Furthermore, the linear lighting and seam tracks can be arranged on the ceiling at a fixed interval based on widths of the ceiling tiles 110 and widths of lighting cavities in the linear lighting tracks 140. In particular, the linear lighting and seam tracks can be arranged: in a lighting-seam-lighting-seam track pattern for high lighting capacity; and in a lighting-seam-seam-lighting-seam-seam track pattern to reduce costs for installations necessitating lower maximum lighting capacities. (Additionally or alternatively, linear lighting tracks 140 can be installed in a lighting-lighting-lighting track pattern for maximum lighting capacity.)

Furthermore, in this example, ceiling tiles 110 can further include: integrated heating and/or cooling elements; and integrated insulation layers that insulate these integrated heating and/or cooling elements and the space below the ceiling tiles 110 from an overhead ceiling cavity 193. These ceiling tiles 110 can also include quick electrical or fluid connects for coupling heating and/or cooling elements in these ceiling tiles 110 to electrical receptacles or fluid manifolds on the ceiling structure 192. A heating and cooling surface, overhead insulation, and a finished ceiling surface can therefore be quickly installed by: plugging these quick electrical or fluid connects to their corresponding electrical receptacles or fluid manifolds on the ceiling structure 192, slipping ends of these ceiling tiles 110 into a ceiling cavity 193 between a linear lighting and seam track pair, and then lowering these ceiling tiles 110 to engage the located features on these linear lighting and seam tracks.

The linear lighting track 140, linear seam track 160, and/or ceiling tiles 110 can further include hard or spring-loaded elements that set and control lateral gaps 153 (i.e., parallel to the linear lighting and seam tracks) and longitudinal gaps 154 (i.e., perpendicular to the linear lighting and seam tracks) between abutting ceiling tile 110. Furthermore, once the ceiling tiles 110 are installed and supported between the linear lighting and seam tracks, vertical positions of the linear lighting tracks 140 can be adjusted via fasteners accessed within the lighting cavity 142—and without removing ceiling tiles 110—to set the ceiling tiles 110 flat and level across the entire ceiling façade system 100.

Therefore, the ceiling façade system 100 can define a finished ceiling system: with fully integrated lighting, heating, cooling, ventilation, fire detection, and/or fire suppression services; that installs rapidly with no onsite modification or custom fitting of ceiling tiles 110; that enables rapid adjustment for vertical alignment of ceiling tiles 110 across a ceiling area; that enables simple inspection and validation of electrical, heating, cooling, ventilation, and fire-related services installed on the ceiling structure 192 both before and after installation of the ceiling façade system 100; and that includes no visible fasteners.

The ceiling façade system 100 is described herein as configured to install over a structure roof system in a residential structure (e.g., a single-family home, a residential accessory dwelling unit)—such as described in U.S. patent application Ser. No. 16/875,079—to form a finished ceiling surface with integrated lighting, heating, cooling, ventilation, fire detection, and/or fire suppression services. However, the ceiling façade system 100 can additionally or alternatively be installed: on a ceiling structure 192 of a multi-story industrial, commercial, or residential building; on a roof structure of a single-story industrial, commercial, or residential building; or on any other roof or ceiling structure 192 to form a finished ceiling surface with integrated lighting, heating, cooling, ventilation, fire detection, and/or fire suppression services.

3. Ceiling Tile

Figure 6B:
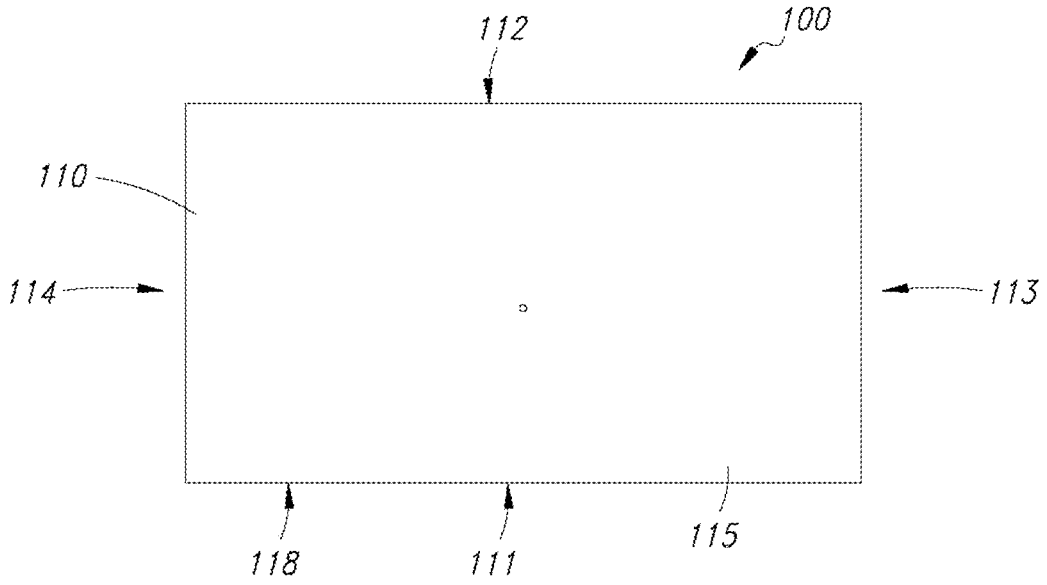

Generally, a ceiling tile 110 of the ceiling façade system 100 includes: an interior panel 115 defining an outer face 118, an inner face, a first edge extending along a first side 111 of the ceiling tile 110, and a second edge extending along a second side 112 of the ceiling tile 110 opposite the first edge; a rear panel 116; and an insulator layer 117 arranged between the interior panel 115 and the rear panel 116, as shown in FIGS. 1, 6A, and 6B. As described below, the ceiling tile 110 can further include: a first receiver 120 extending along a first side 111 of the ceiling tile 110, configured to support the first side 111 of the ceiling tile 110 on the first locating feature 145 of the first linear lighting track 140 and configured to locate the first edge of the interior panel 115 of the ceiling tile 110 adjacent and concealing the first locating feature 145 of the first linear lighting track 140; and a second receiver 130 extending along a second side 112 of the ceiling tile 110 and configured to support the second side 112 of the ceiling tile 110 on the second locating feature 161 of the linear seam track 160. Generally, the ceiling tile 110 defines a rigid, insulated panel including both a pre-finished interior surface and features configured to engage locating features on the linear lighting and seam tracks.

3.1 Interior Panel

In one implementation, the interior panel 115 includes a thin, square or rectangular sheetmetal (e.g., aluminum, steel) element with hemmed edges. In this implementation, the interior panel 115 can define a smooth outer face, such as painted with a glossy or flat paint to form a pre-finished interior surface.

Alternatively, a vinyl cover, wood veneer, a thermoplastic or a thermoset polymer coating, or melamine layer can be stretched or applied over the outer face of the interior panel 115 to form the pre-finished interior surface.

Yet alternatively, the outer face of the interior panel 115 can be coated with a colored cementitious material to form a sound-dampening pre-finished interior surface.

Additionally or alternatively, the interior panel 115 can be embossed, such as with a repeating hexagonal pattern or a repeating sawtooth pattern for sound-dampening.

However, the interior panel 115 of the ceiling tile 110 can be of any other material, geometry, or surface finish.

3.2 Rear Panel

The rear panel 116 can be of a similar material and geometry as the interior panel 115, such as a thin, square or rectangular sheetmetal element with hemmed edges. Alternatively, the rear panel 116 can be formed or fabricated in a plywood panel, a pressed wood panel, paper, a gypsum panel (e.g., a fire-rated gypsum backer board), a fiber cement panel, or any other material.

3.3 Receivers

The ceiling tile 110 also includes a first receiver 120 and a second receiver 130: arranged on opposing sides of the ceiling tile 110; extending longitudinally parallel to the linear lighting and seam tracks; and configured to mate with locating features on the linear lighting track 140 and linear seam track 160, respectively, to locate and suspend the ceiling tile 110 from the ceiling structure 192.

In one implementation, the first receiver 120: extends along the first side 111 of the ceiling tile 110; is configured to support the first side 111 of the ceiling tile 110 on a first locating feature 145 of a linear lighting track 140 arranged on a ceiling structure 192; and configured to locate the first edge of the interior panel 115 of the ceiling tile 110 adjacent and concealing the first locating feature 145 (and an unfinished edge) of the linear lighting track 140. In this implementation, the second receiver 130: extends along the second side 112 of the ceiling tile 110; and is configured to support the second side 112 of the ceiling tile 110 on a second locating feature 161 of a linear seam track 160 arranged on the ceiling structure 192, the linear seam track 160 laterally offset from the linear lighting track 140.

In this implementation, the first and second receivers 120, 130 can define flat, linear surfaces that fall in a common horizontal plane parallel to the outer face 118 of the ceiling tile 110. The corresponding locating feature on the linear lighting and seam tracks can similarly define flat, linear surfaces that fall in a common horizontal plane. Thus, when the ceiling tile 110 is installed on a linear lighting and seam track pair with the first and second receivers 120, 130 mating with the corresponding first and second locating features 145, 161 on the linear lighting and seam track pair, as described below, the first and second receivers 120, 130 impart a vertical load only into the first and second locating features 145, 161 such that the ceiling tile 110 does not fall into a "low" position between the first and second locating features 145, 161. Accordingly, a spring-loaded element 151 on the ceiling tile 110 or adjacent element of the ceiling façade system 100 may drive the ceiling tile 110 toward an adjacent ceiling tile 110 to close and control a gap between the ceiling tile 110 and the adjacent ceiling tile 110, as described below. Alternatively, an installer may manually push rows or columns of such ceiling tiles 110 together to close gaps between adjacent ceiling tiles 110; because the first and second receivers 120, 130 impart a vertical load only into the first and second locating features 145, 161, the ceiling tiles 110 may remain in the position thus set by the installer.

In one example, the first and second receivers 120, 130 can include aluminum U-channel extrusions and can be integrated into the ceiling tile 110 with the cavities defined by these U-channel extrusions facing laterally outward from the ceiling tile 110, as shown in FIG. 6A. In a similar example, the first and second receivers 120, 130 are formed of folded sheetmetal structures separately from the interior and rear panels 115, 116.

In another implementation, the rear panel 116 (or the interior panel 115) of the ceiling tile 110 and the first and second receivers 120, 130 are physically coextensive—that is, formed from a common structure. For example, the rear panel 116, the first receiver 120, and the second receiver 130 can be formed from a single folded sheetmetal structure in which: a first 90° return and 90° flange extending from a first hem along a first edge of the rear panel 116 forms the first receiver 120; and a second 90° return and 90° flange extending from a second hem along the second, opposing edge of the rear panel 116 forms the second receiver 130.

In one variation, the first and second receivers 120, 130 define surfaces that slope downwardly toward the lateral center of the ceiling tile 110 when the ceiling tile 110 is installed between the linear lighting and seam track pair. In this variation, the first and second locating features 145, 161 of the linear lighting and seam tracks can define complementary sloped surfaces such that the ceiling tile 110 settles (or "falls") to a "low" position between the linear lighting and seam tracks to set a lateral position of the ceiling tile 110 between the linear lighting and seam tracks.

However, the first and second receivers 120, 130 can define any other linear geometry configured to mate with corresponding locating features on the linear lighting and seam tracks.

(In one variation, the first receiver 120 and the first locating feature 145 can define a pin and receiver pair (e.g., respectively or vice versa) arranged on the ceiling tile 110 and the linear lighting track 140 and that cooperate to constrain the first side of the ceiling tile 110 vertically on the linear lighting track 140. Similarly, in this variation, the second receiver 130 and the second locating feature 161 can define a pin and receiver pair (e.g., respectively or vice versa) arranged on the ceiling tile 110 and the linear seam track 160 and that cooperate to constrain the second side of the ceiling tile 110 vertically on the linear seam track 160.)

3.4 Insulator Layer and Assembly

The insulator layer 117 is arranged between and offsets the interior and rear panels 115, 116 and is configured to thermally and acoustically insulate the interior panel 115 from the ceiling structure 192 above.

In one implementation, to fabricate the ceiling tile 110, the interior and rear panels 115, 116 are retained and offset in a ceiling tile jig by a target final thickness of the ceiling tile 110. In the variation described below in which the ceiling tile 110 includes a heating element 180, the heating element 180 is located against, bonded to, or fastened to the inner face of the interior panel 115. In this implementation, the receivers are located along the ceiling tile 110 periphery defined by the jig and between the inner and rear panels 115, 116. An expanding foam is then injected—such as through an opening (or "window," "bore") in the rear panel 116—into an enclosed volume thus defined between the interior panel 115, the rear panel 116, and the receivers. For example, isocyanate and polyol resin can be injected into the opening in the rear panel 116 and that expands to form closed-cell polyurethane foam that: fills the ceiling tile 110; bonds the heating element 180, receivers, rear panel 116, and interior panel 115 to form a single, rigid ceiling tile 110 assembly; retains the heating element 180 against the interior panel 115; and insulates the interior panel 115 and heating element 180 from the rear panel 116.

In this implementation, the ceiling tile jig can define hard points (or "datums") that accurately repeatably locate the interior panel 115, the rear panel 116, and the receivers such that ceiling tiles 110 assembled in the ceiling tile jig exhibit similar flatness, overall widths, overall lengths, overall thicknesses, and/or distances between receivers within a narrow tolerance (e.g., +/−0.010" per linear foot of ceiling tile 110 length). For example, the ceiling tile jig can define hard points that: locate the outer face 118 of the interior panel 115 across a plane; locate the receivers parallel to the outer face 118 of the interior panel 115; locate the opposing receivers at a target offset distance corresponding to the distance between adjacent linear lighting and seam tracks installed on the ceiling structure 192; and/or offset the receivers from the outer face 118 of the interior panel 115 by a "drop distance" to obscure linear lighting and seam tracks behind edges of the interior panel 115 of the ceiling tile 110 once installed.

Additionally or alternatively, in the foregoing implementation, the interior panel 115, the rear panel 116, the receivers, and/or the heating element 180 of the ceiling tile 110 can be fastened or bonded together prior to injection of the expanding foam into the enclosed volume formed by these components, such as with threaded fasteners, rivets, or an adhesive.

In another example, the insulator layer 117 includes a precast foam panel, and the interior and rear panels 115, 116 of the ceiling tile 110 are bonded to the front and rear faces of the foam panel, respectively to form the ceiling tile 110. In the variation described below in which the ceiling tile 110 also includes a heating element 180, a cavity for the heating element 180 can be cast into the foam panel; the heating element 180 can therefore be installed in the cavity in the insulator layer 117 before the interior panel 115 is bonded to the foam panel. In this variation, the heating element 180 can also be potted into the cavity and/or against the interior panel 115, such as with a silicone caulk or expanding foam.

However, the insulating layer can be of any other material, can define any other format, and can be assembled or formed between the interior and rear panels 115, 116 of the ceiling tile 110 in any other way.

4. Linear Seam Track

Figure 5:
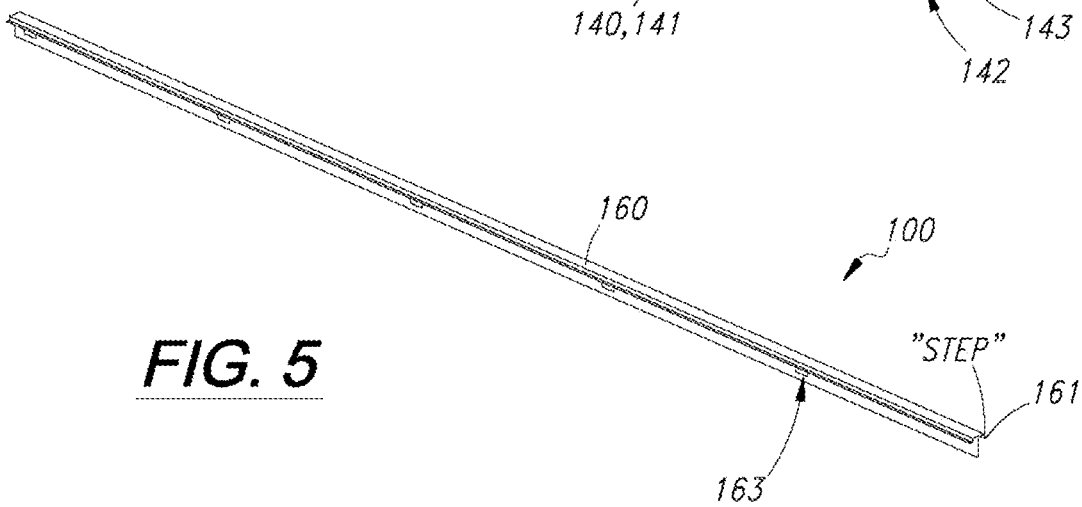
FIG. 5 is a schematic representation of one variation of the ceiling façade system.

As shown in FIG. 5, the linear seam track 160: includes a second locating feature 161 extending laterally toward the first locating feature 145 and located along a second length of the linear seam track 160; and is configured to locate on the ceiling structure 192 laterally offset from the linear light track.

Generally, the linear seam track 160 includes a pair of horizontally-opposed second locating features 161 configured to support—and to be concealed by—ends of two abutting ceiling tile rows. In one implementation, the linear seam track 160 is configured to fasten directly to the ceiling structure 192. For example, the linear seam track 160 can include an extruded structure (e.g., an aluminum extrusion) or a folded sheetmetal (e.g., steel) structure defining an "I" profile in which: the flanges extending from the top of the linear seam track 160 include through-bores through which the linear seam track 160 is fastened to the ceiling structure 192; and the flanges extending from the bottom of the linear seam track 160 form a pair of second locating features 161, as shown in FIG. 1.

Figure 9:
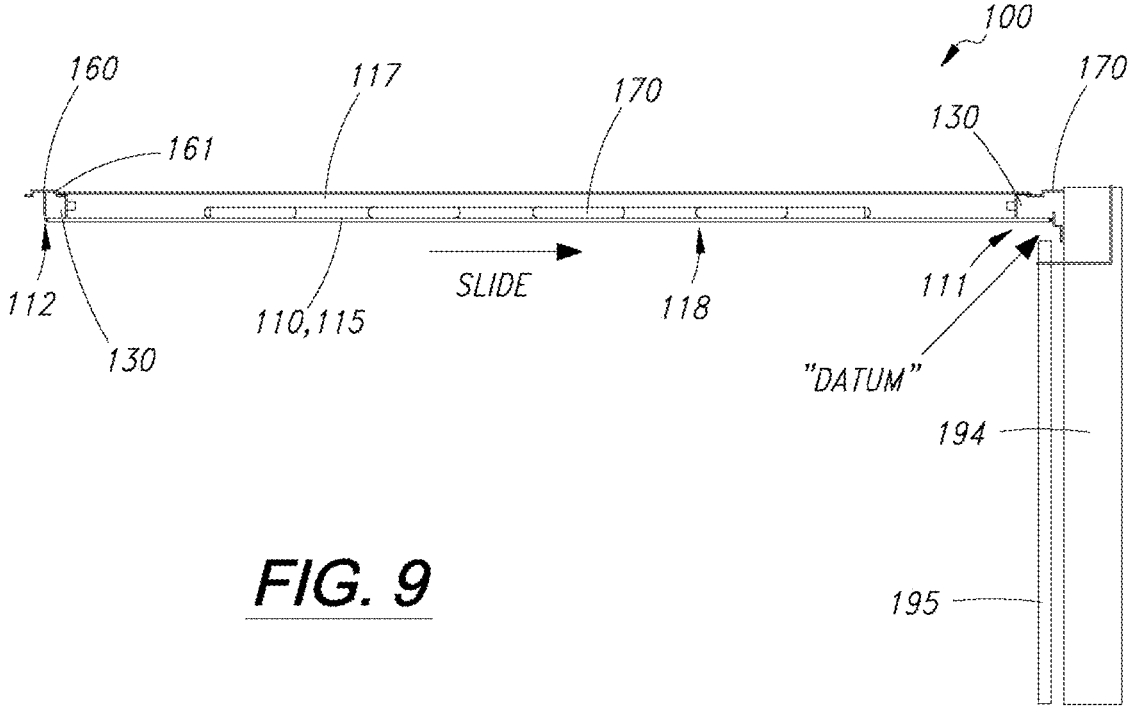
FIG. 9 is a schematic representation of one variation of the ceiling façade system.
Figure 10:
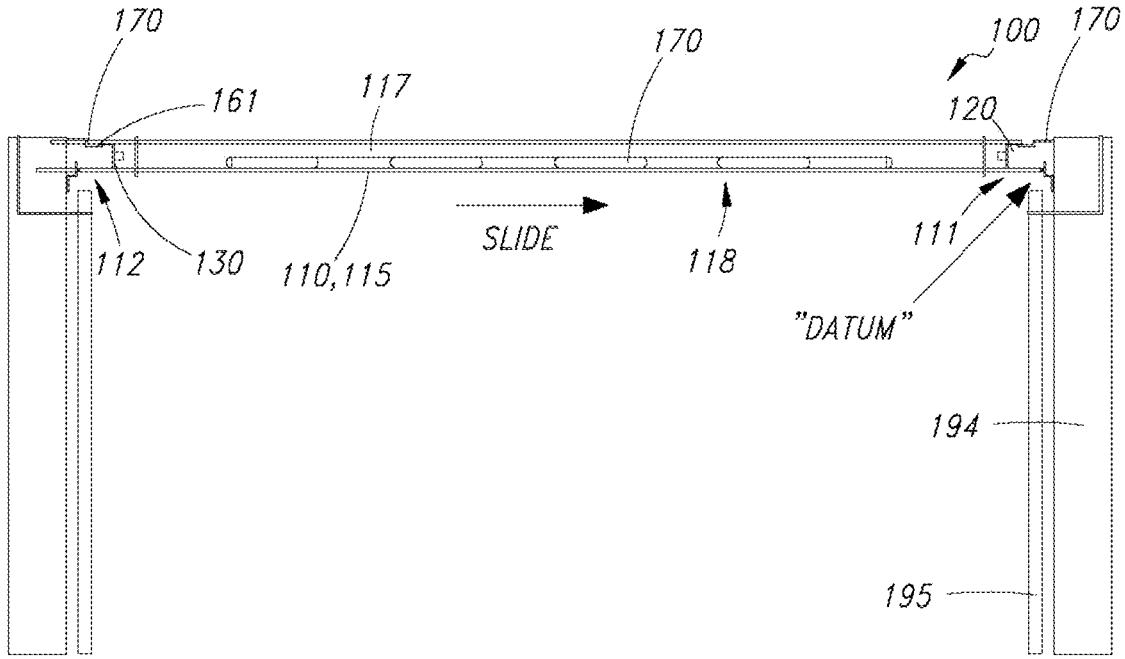
FIG. 10 is a schematic representation of one variation of the ceiling façade system.

In a similar implementation, the linear seam track 160 includes a cast, extruded, or folded structure defining a "T" profile. In this implementation, the top of the "T" profile of the linear seam track 160 can define a top flange extending laterally from each side of the spine 163 of the linear seam track 160 to define a mounting flange including a series of bores through which the linear seam track 160 mounts to the ceiling structure 192. In this implementation and as shown in FIGS. 2 and 9, each side of this top flange can also include: a step extending below the top flange (e.g., by height approximating a target ceiling cavity 193 depth between installed ceiling tiles 110 and the ceiling structure 192); and a secondary flange extending laterally outward from the step to form a second locating feature 161. Furthermore, in this implementation, the spine 163 of the linear seam track 160 can extend downwardly to form a hard stop 162 (e.g., a datum) configured to: abut corresponding features of ceiling tiles 110 installed on the linear seam track 160; set a lateral offset between abutting edges of these ceiling tiles 110; and thus set and control a gap between the abutting edges of these ceiling tiles 110. For example, in this implementation, the adjacent linear lighting track 140 can include a spring-loaded element 151 or threaded element 152 extending laterally toward the linear seam track 160 and configured to bias a ceiling tile 110—installed between this linear lighting and seam track pair—toward the linear seam track 160 such that a second edge of this ceiling tile 110 (or a secondary feature adjacent and inset rearward from the second edge of the ceiling tile 110) engages the spine 163 of the linear seam track 160, thereby setting the lateral position of the ceiling tile 110 between the linear lighting and seam track pair and controlling a gap between the second edge of the ceiling tile 110 and the second edge of an adjacent ceiling tile 110 installed on the opposing side of the linear seam track 160.

Therefore, in the foregoing implementation, the linear seam track 160 can include: a flange configured to fasten against the ceiling structure 192; a pair of opposing locating features 161 extending and offset from the flange; and spine 163 that defines an integrated datum laterally locating abutting rows of ceiling tiles 110 and setting a lateral gap 153 between these ceiling tile rows. (Alternatively, in a similar implementation, the second locating features 161 of the linear seam track 160 can extend laterally from the spine 163 of the linear seam track 160 rather than the top flange of the linear seam track 160, such as to accommodate taller ceiling cavity 193 heights between installed ceiling tiles 110 and the ceiling structure 192.) The spine 163 can also mate with edges of the rear panels 116 of two adjacent ceiling tiles in order to set the visible gap between these two ceiling tiles 110 while also remaining hidden behind these ceiling tiles.

In the foregoing implementations, the linear seam track 160 can therefore be fastened to the ceiling structure 192 with a set of threaded fasteners. Additionally or alternatively, the linear seam track 160 can be: riveted to the ceiling structure 192; bonded to the ceiling structure 192; or installed on the ceiling structure 192 with a set of clips integrated into the ceiling structure 192.

In another implementation, the linear track includes: a cast, extruded, or folded structure defining an "inverted-T" profile; and a set of threaded rods extending from the spine 163 of the linear seam track 160. In this implementation, the linear seam track 160 can be: fastened to the ceiling structure 192 by passing the threaded rods through corresponding through-bores in the ceiling structure 192; or casting these threaded rods into a cast (e.g., concrete, foam) ceiling structure 192.

However, the linear seam track 160 can define any other material or geometry and can be installed on or integrated into the ceiling structure 192 in any other way.

Furthermore, the linear seam track 160 can be manufactured in long lengths (e.g., 40 feet) and cut to length to span the full length of a space in a particular installation, such as in the example described above in which the linear seam track 160 defines an aluminum extrusion.

Additionally or alternatively, linear seam tracks 160 can be manufactured in a fixed length (e.g., eight feet) and then assembled to form a longer assembly that spans the full length of a space in a particular installation, such as in the example described above in which the linear seam track 160 defines a folded sheetmetal structure.

5. Linear Lighting Track

Figure 4:
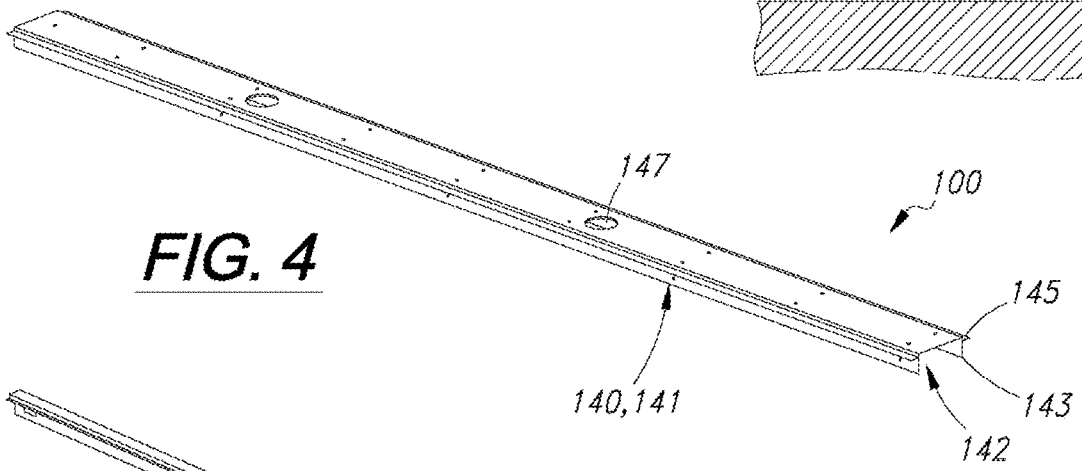
FIG. 4 is a schematic representation of one variation of the ceiling façade system.

As shown in FIG. 4, the linear lighting track 140 includes: a body 141 defining a lighting cavity 142 facing downwardly from the ceiling structure 192; and a light socket 146 arranged in the lighting cavity 142 and configured to receive a light element. Generally, the linear lighting track 140 is configured to fasten to the ceiling structure 192, defines a lighting cavity 142 configured to house a group of services (e.g., lighting, forced-air ventilation, fire-detection, and/or fire-suppression); and is configured to support a row of ceiling tiles 110 along on one or both sides of the lighting cavity 142.

5.1 Body and First Location Features

Figure 7:
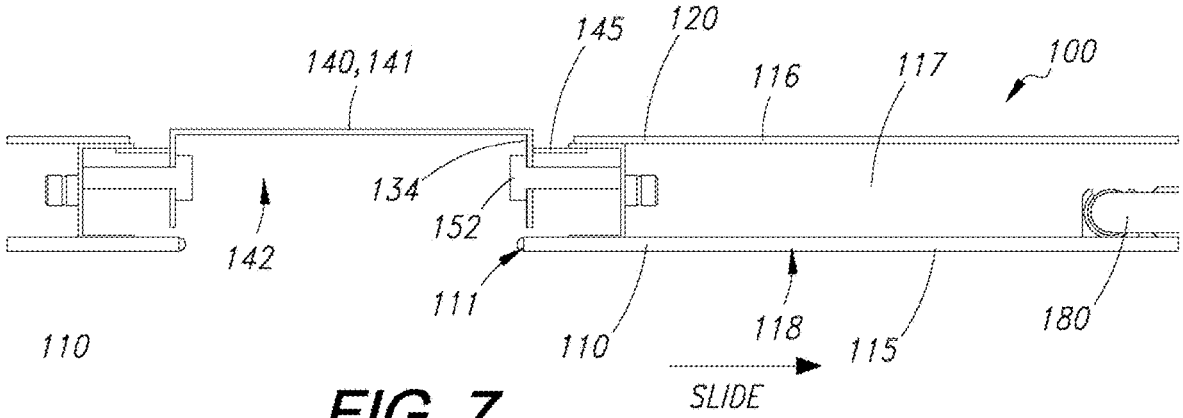
FIG. 7 is a schematic representation of one variation of the ceiling façade system.
Figure 8:
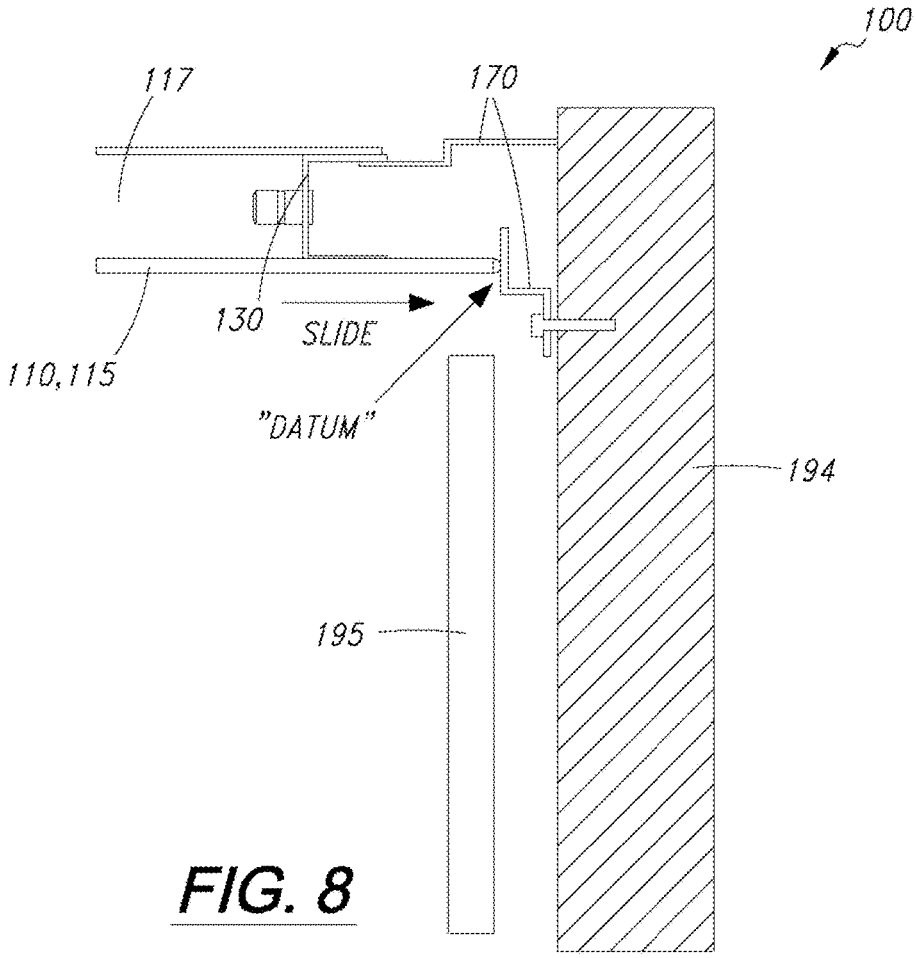
FIG. 8 is a schematic representation of one variation of the ceiling façade system.

In one implementation shown in FIGS. 1 and 7, the linear lighting track 140 includes: a body 141 (or a "light track housing") that forms the lighting cavity 142; and a flange that extends from each side of the body 141 to form first locating features 145 configured to locate and support first sides 111 of ceiling tiles 110.

For example, the body 141 can include an extruded aluminum or folded sheetmetal (e.g., steel) structure defining an "inverted-U" profile extending linearly along the length of the linear lighting track 140. In this example, the linear lighting track 140 can also include a flange extending laterally from each side of the U-profile of the body 141—and offset below the base of the U-profile by a height approximating the target ceiling cavity 193 depth between installed ceiling tiles 110 and the ceiling structure 192. In this example, the body 141 and these flanges can form a unitary structure, such as in the form of an aluminum extrusion or a folded sheetmetal structure. Alternatively, the body 141 and these flanges can be fabricated separately and subsequently bonded, welded, riveted, or otherwise assembled to form the linear lighting track 140.

Furthermore, a return of the U-profile of the body 141 can extend below the first locating features by a length approximating (e.g., slighting less than) a distance: from the outer face 118 of the first receiver 120—on a ceiling tile 110—that mates with the first locating feature 145 on the linear lighting track 140; to the rear face of the interior panel 115 of the ceiling tile 110. Therefore, when a ceiling tile 110 is installed on the linear lighting track 140, the return of the body 141 extends very near (e.g., inset by a nominal gap width of 0.10") the first end of the interior panel 115 of the ceiling tile 110 that overlaps this end of the body 141. For example, for a 3"-thick ceiling tile 110 with a nominal distance of 2.5" between the outer face 118 of the first receiver 120 and the rear face of the interior panel 115 and for a nominal gap width of 0.10", each return of the U-profile of the body 141 can be offset below the first locating features 145 of the linear lighting track 140 by a nominal distance of 2.40". Therefore, the returns of the body 141 can conceal the sides of abutting ceiling tiles 110 and the receivers on the sides of these ceiling tiles 110 when the ceiling façade system 100 is assembled.

However, the body 141 and first locating features 145 of the linear lighting track 140 can define any other geometry or material.

5.2 Linear Lighting Track Length

Furthermore, the linear lighting track 140 can be manufactured in long lengths (e.g., 40 feet) and cut to length to span the full length of a space in a particular installation, such as in the example described above in which the body 141 and first located features of the linear lighting track 140 define an aluminum extrusion.

Additionally or alternatively, linear lighting tracks 140 can be manufactured in a fixed length (e.g., eight feet) and then assembled to form a longer assembly that spans the full length of a space in a particular installation, such as in the example described above in which the body 141 and first located features of the linear lighting track 140 define a folded sheetmetal structure.

5.3 Light Socket

Furthermore, the linear lighting track 140 includes a set of light sockets 146 (or integrated light elements) arranged in the lighting cavity 142. For example, the linear lighting track 140 can include a set of light sockets 146—configured to locate and power circular light elements—arranged at fixed intervals along the length of the linear lighting track 140. Alternatively, the linear lighting track 140 can include: a light track arranged in the lighting cavity 142; and a set of light sockets 146 adjustably mounted to the light track, thereby enabling a user to adjust density of light elements along the length of the linear lighting track 140. In yet another implementation, the linear lighting track 140 includes one or more light sockets 146 configured to locate and power linear light elements, such as linear fluorescent tube lights or an LED string.

Furthermore, the linear lighting track 140 can include a single electrical connector: connected to each light socket 146 in the linear lighting track 140; and configured to plug into a switched electrical receptacle on the ceiling structure 192 (or on an adjacent wall structure 194 or on an adjacent linear lighting track 140). Thus, an installer may fasten the linear lighting track 140 to the ceiling structure 192 and then plug the electrical connector directly into the electrical receptacle on the ceiling structure 192 (or on an adjacent wall structure 194 or on an adjacent linear lighting track 140) to complete installation of the linear lighting track 140.

5.4 Sensors

In one variation, the linear lighting track 140 further includes an integrated suite of sensors arranged within the lighting cavity 142. For example, the linear lighting track 140 can include a sensor cluster including: a smoke detector; a humidity sensor; an ambient light level sensor; a motion sensor; and/or a temperature sensor. The linear lighting track 140 can also include multiple sensor clusters arranged along the length of the linear lighting track 140.

In this variation, the linear lighting track 140 can also include a processor configured to convert analog signals from these sensors into digital signals. In this implementation, the single electrical connector described above can include both: power lines configured to supply current from the electrical receptacle to the light sockets 146 to power the light element; and a data line configured to return digital sense signals from the processor to the electrical receptacle (which may route these digital sense signals to a primary controller in the building 190). Alternatively, in this variation, the sensors and/or the processor can be connected to a second, discrete electrical connector configured to connect to the electrical receptacle or to another low-power receptacle on the ceiling structure 192.

Furthermore, in this variation, the linear lighting track 140 can include multiple sensor clusters arranged along its length. However, in this variation, the linear lighting track 140 can include any other type or arrangement of sensors within or coupled to the lighting cavity 142.

5.5 Sprinkler

In one variation, the linear lighting track 140 further includes: an integrated local manifold and sprayers (or "sprinklers") for fire suppression.

In one example, the linear lighting track 140 includes: a row of sprayers arranged at intervals along the length of the linear lighting track 140, such as arranged longitudinally between light sockets 146 along the length of the linear lighting track 140; a local manifold that fluidly couples these sprayers; and a flexible fluid light within a quick-connect fluid coupling connected to the local manifold. In this example, during assembly, an installer may install the linear lighting track 140 on the ceiling structure 192, as described below, and the plug the quick-connect fluid coupling into a water supply (e.g., a port of a primary manifold) on the ceiling structure 192 or on an adjacent ceiling tile 110 to complete assembly of a fire suppression system within the building 190.

5.6 Mounting

In one implementation, the linear lighting track 140 is configured to mount to the ceiling structure 192 with the linear lighting track 140 constrained in lateral and longitudinal location on the ceiling structure 192 and adjustable vertically on the ceiling structure 192, thereby enabling the vertical adjustment of first edges of ceiling tiles 110 installed on the linear lighting track 140 in order to set these ceiling tiles 110 in a flat, level, and flush condition.

For example, in this implementation, the linear lighting track 140 can include: a spring element 150 configured to bias the linear lighting track 140 downward from the ceiling structure 192; and a fastener configured to mount the linear lighting track 140 to the ceiling structure 192; and adjustable to offset the first locating feature 145 below the ceiling structure 192, locate the first locating feature 145 parallel to the second locating feature 161, and locate outer faces 118 of interior panels 115 of ceiling tiles 110 in the first row of ceiling tiles 110 coplanar with outer faces 118 of interior panels 115 of ceiling tiles 110 in the second row of ceiling tiles 110.

In particular, in this example, the linear lighting track 140 includes a series of slots (or through-bores) spaced along the top of the body 141 of the linear lighting track 140 (e.g., the base of the lighting cavity 142). In this example, a threaded fastener (e.g., a fine-thread machine screw) may be inserted through a slot in the linear lighting track 140 and threaded into a corresponding threaded bore or nuts (e.g., a riv-nut, a pem-nut) located on the ceiling structure 192. During assembly, a spring element 150 can be arranged over this threaded fastener and located between the body 141 of the linear lighting track 140 and the ceiling structure 192 such that the spring element 150 biases the linear lighting track 140 downward and off of the ceiling structure 192. This fastener and spring element 150 assembly can be repeated at each slot location on the linear lighting track 140.

In this example, the heads of these fasteners can be accessible within the lighting cavity 142—even with ceiling tiles 110 installed on each side of the linear lighting track 140. An installer may therefore raise a local section of the linear lighting track 140 (i.e., on each side of a fastener and spring element assembly) toward the ceiling structure 192—and thus raise the first side 111 of an adjacent ceiling tile 110 relative to the second side 112 of this ceiling tile 110 supported on the adjacent linear seam track 160—by tightening the threaded fastener(s) within this local section of the linear lighting track 140. Similarly, the installer may lower this local section of the linear lighting track 140 from the ceiling structure 192—and thus lower the first side 111 of the adjacent ceiling tile 110 relative to the second side 112 of the ceiling tile 110—by loosening the threaded fastener(s) within this local section of the linear lighting track 140. The linear lighting track 140 can therefore include a row of slots and fastener/spring assemblies that enable the installer to quickly level all ceiling tiles 110 across a ceiling (i.e., bring the outer faces of these ceiling tiles 110 to a common plane, such as within a tolerance of 0.05" over ten feet lateral or longitudinal distance) by adjusting these threaded fasteners and without removing any ceiling tiles 110, light elements, grills, or trim, etc. from the ceiling assembly.

Furthermore, the linear lighting track 140 can also include two parallel rows of slots and fastener/spring assemblies along the length of the linear lighting track 140. Thus, in this example, the installer may tighten fasteners in the first row to raise a first side 111 of the linear lighting track 140 and loosen fasteners in the second row to lower a second side 112 of the linear lighting track 140, thereby: changing a roll angle of the linear lighting track 140 (i.e., rolling the linear lighting track 140 toward the first side 111 of the linear lighting track 140); raising the first sides 111 of ceiling tiles 110 installed on the first side 111 of the linear lighting track 140; and lowering the first sides 111 of ceiling tiles 110 installed on the second side 112 of the linear lighting track 140. Therefore, the linear lighting track 140 can include two parallel rows of slots and fastener/spring assemblies to enable the installer to set the roll position of the linear lighting track 140 and to bring first ends of ceiling tiles 110—installed on each side of the linear lighting track 140—into a flat and level condition.

Alternatively, the linear lighting track 140 can include: a single row of slots and fastener/spring assemblies centered along the length of the linear lighting track 140; and two rows of threaded bores arranged on each side of the row of slots. In this example, secondary vertical locking fasteners (e.g., set screws) can be installed in each of these threaded bores and tightened against the ceiling structure 192 to: mechanically prevent lifting of the linear lighting track 140 against the spring elements 150 and toward the ceiling structure 192; and to enable roll adjustment of the linear lighting track 140 against the ceiling structure 192, such as by tightening secondary vertical locking fasteners in the first row of threaded bores and loosening secondary vertical locking fasteners in the second row of threaded bores.

However, the linear lighting track 140 can include any other adjustment element or feature configured to enable vertical height adjustment and/or roll adjustment of the linear lighting track 140 on the ceiling structure 192.

Figure 3:
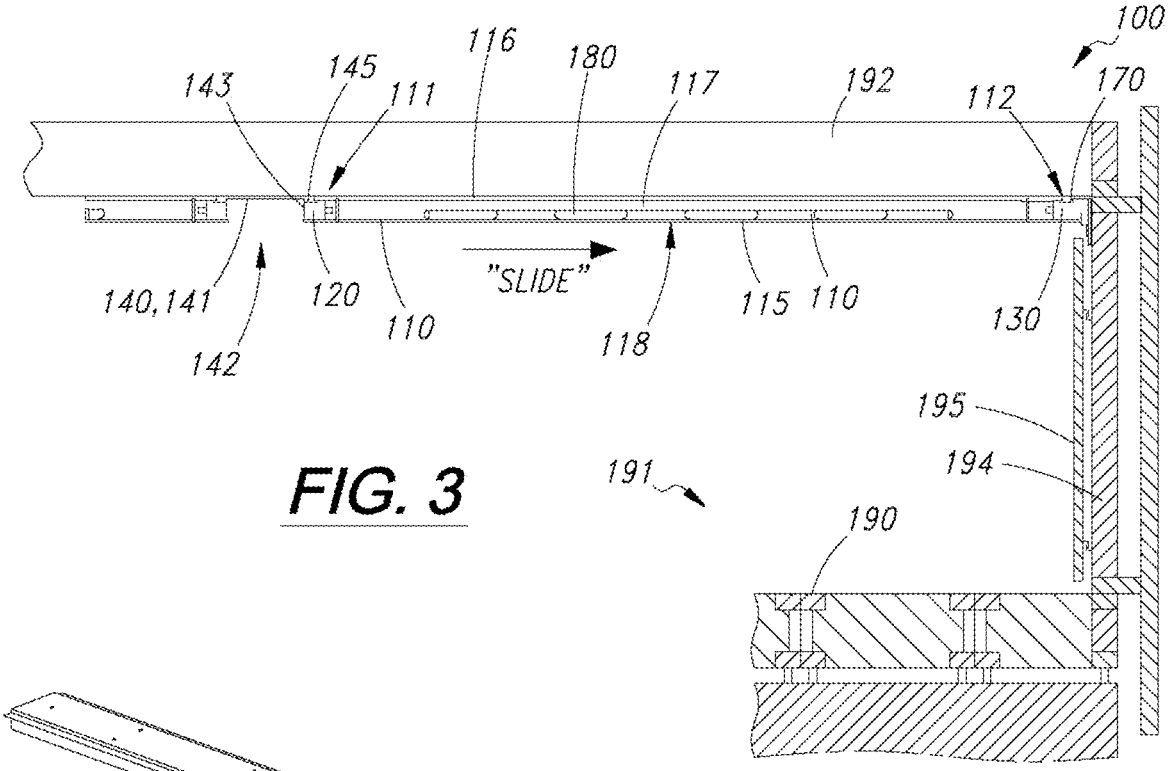
FIG. 3 is a schematic representation of one variation of the ceiling façade system.

Alternatively, the linear lighting track 140 can be configured to rigidly mount to the ceiling structure 192, such as with threaded fasteners, ceiling clips, and/or an adhesive, as shown in FIGS. 2 and 3.

6. Receiver and Locating Feature Geometry

Therefore, the first locating feature 145 of a linear lighting track 140 includes a flange extending laterally from the body 141 opposite the lighting cavity 142. Accordingly, the first receiver 120 of a ceiling tile 110 defines a first recess extending longitudinally along the first side 111 of the ceiling tile 110 and configured to receive the first locating feature 145 of the linear lighting track 140. Furthermore, the first edge of the interior panel 115 of a ceiling tile 110: defines a projection extending laterally from the first recess defined by the first receiver 120; and extends over a portion of the lighting cavity 142 of the linear lighting track 140 and conceals a portion of the body 141 of the linear lighting track 140 when the ceiling tile 110 is installed between the linear lighting track 140 and a linear seam track 160.

Similarly, a linear seam track 160 includes a second locating feature 161 that extends laterally along a length of the linear seam track 160. Accordingly, the second receiver 130 of a ceiling tile 110 defines a second recess extending longitudinally along the second side 112 of the ceiling tile 110. Furthermore, the second edge of the interior panel 115: defines a projection extending laterally from the second recess defined by the second receiver 130; extends over the second locating feature 161 of the linear seam track 160 when the ceiling tile 110 is installed between the linear lighting track 140 and the linear seam track 160; and cooperates with a second ceiling tile 110—installed on the linear seam track 160 adjacent the ceiling tile 110—to conceal the linear seam track 160 when the ceiling tile 110 is installed on the linear lighting track 140 and the linear seam track 160.

To enable the lateral positional adjustment of the ceiling tile 110 between the linear lighting and seam tracks and to enable an installer to first install the first side 111 of the ceiling tile 110 on the linear lighting track 140 and raise the second side 112 onto the linear seam track 160 (or vice versa) before centering the ceiling tile 110 between the linear lighting and seam tracks: the first locating feature 145 of the linear lighting track 140 can define a first lateral width (e.g., 1") and a first thickness (e.g., 0.060"); the first receiver 120 can defines a second lateral depth (e.g., 1") and a second height greater (e.g., 2.5") than first thickness; and the first edge of the interior panel 115 of the ceiling tile 110 can extend laterally from the recess by a third length (e.g., 1.75") greater than first lateral width and less than a sum of the first lateral width and the second lateral width. For example, a first lateral width of 1", a second lateral depth of 1", and a third length of 1.75" can provide between 0.25" and 1" of lateral engagement between the first receiver 120 and the first locating feature 145 with up to +/−0.375" of lateral positional adjustment of the ceiling tile 110 on the linear lighting track 140.

The linear seam track 160 and the second receiver 130 of the ceiling tile 110 can define a similar geometry. For example, the second locating feature 161 can define a lateral width of 1", the second receiver 130 can define a lateral depth of 1", and the second edge of the interior panel 115 can extend beyond the second receiver 130 by a length of 1.75" to provide between 0.25" and 1" of lateral engagement between the second receiver 130 and the second locating feature 161 with up to +/−0.375" of lateral positional adjustment of the ceiling tile 110 on the linear seam track 160.

7. Installation: Linear Lighting and Seam Tracks

To install the ceiling façade system 100 on a ceiling structure 192, an installer may fasten a set of linear lighting tracks 140 and linear seam tracks 160 to the ceiling structure 192. For example, for an installation with moderate lighting requirements, the installer may install linear lighting tracks 140 and linear seam tracks 160 in a lighting-seam-lighting-seam track pattern. In this example, the installer may offset a linear seam track 160 from an adjacent linear lighting track 140 by a lateral center-to-center distance approximately equal to: the sum of the width of a ceiling tile 110 (e.g., 4') and half the width of the light cavity of the linear lighting track 140 (e.g., half of 6"); less a minimum overlap distance of the first edge of the interior panel 115 of the ceiling tile 110 into the lighting cavity 142 of the linear lighting track 140 (e.g., 0.25"); and less half a target gap width between the second edge of ceiling tiles 110 abutting at the linear seam track 160 (e.g., 0.125").

The installer may then install a first ceiling tile 110 between a linear lighting and seam track pair by: angling the first side 111 of the ceiling tile 110 toward the ceiling structure 192; setting the first receiver 120 on the first side 111 of the ceiling tile 110 onto the first locating feature 145 of the linear lighting track 140; pushing the first end of the ceiling tile 110 toward the linear lighting track 140 to engage the first receiver 120 against the first locating feature 145; raising the second end of the ceiling tile 110 toward the second locating feature 161 of the linear seam track 160; raising the second receiver 130 of the ceiling tile 110 above the second locating feature 161 of the linear seam track 160; shifting the ceiling tile 110 laterally toward the linear seam track 160; and releasing the ceiling tile 110 to enable the second receiver 130 to engage the second locating feature 161. The first and second receivers 120, 130 of the ceiling tile 110 can thus support the ceiling tile 110 on the first and second locating features 145, 161 of the linear lighting and seam tracks, respectively. Furthermore, the first edge of the interior panel 115 of the ceiling tile 110 can extend into the lighting cavity 142 to conceal the near side of the linear lighting track 140 (e.g., the edge of the near return of the body 141 of the linear lighting track 140); and the second end of the ceiling tile 110 can extend over and conceal the near side of the linear seam track 160. (In one variation, the ceiling tile 110 further includes a cable fastened to the rear panel 116 of the ceiling tile 110; during installation, the installer may also fasten the distal end of this cable to the ceiling structure 192 such that the cable catches and retains the ceiling tile 110 when lowered from the linear lighting and seam tracks when infrastructure behind the ceiling façade system 100 is serviced.)

Figure 12:
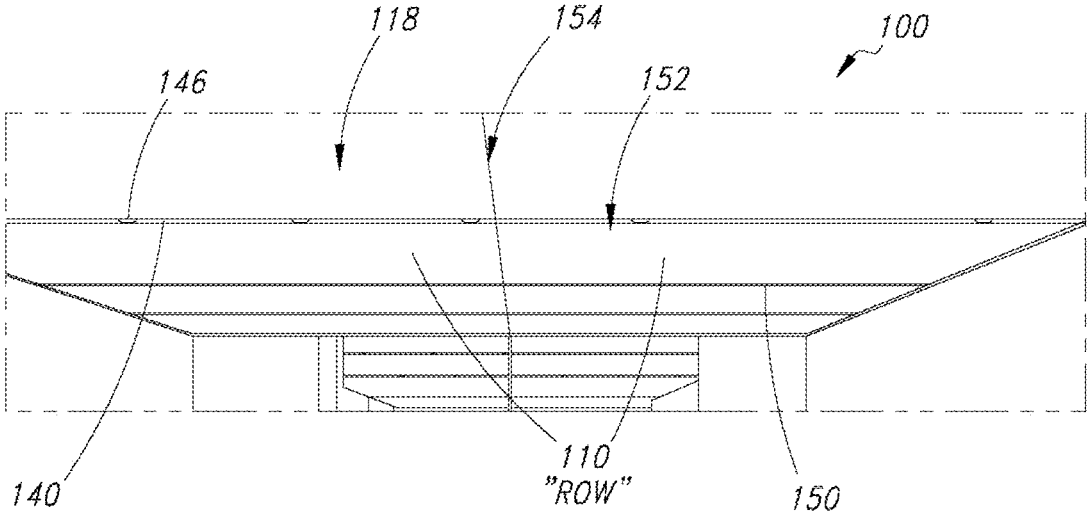
FIG. 12 is a schematic representation of one variation of the ceiling façade system.
Figure 13:
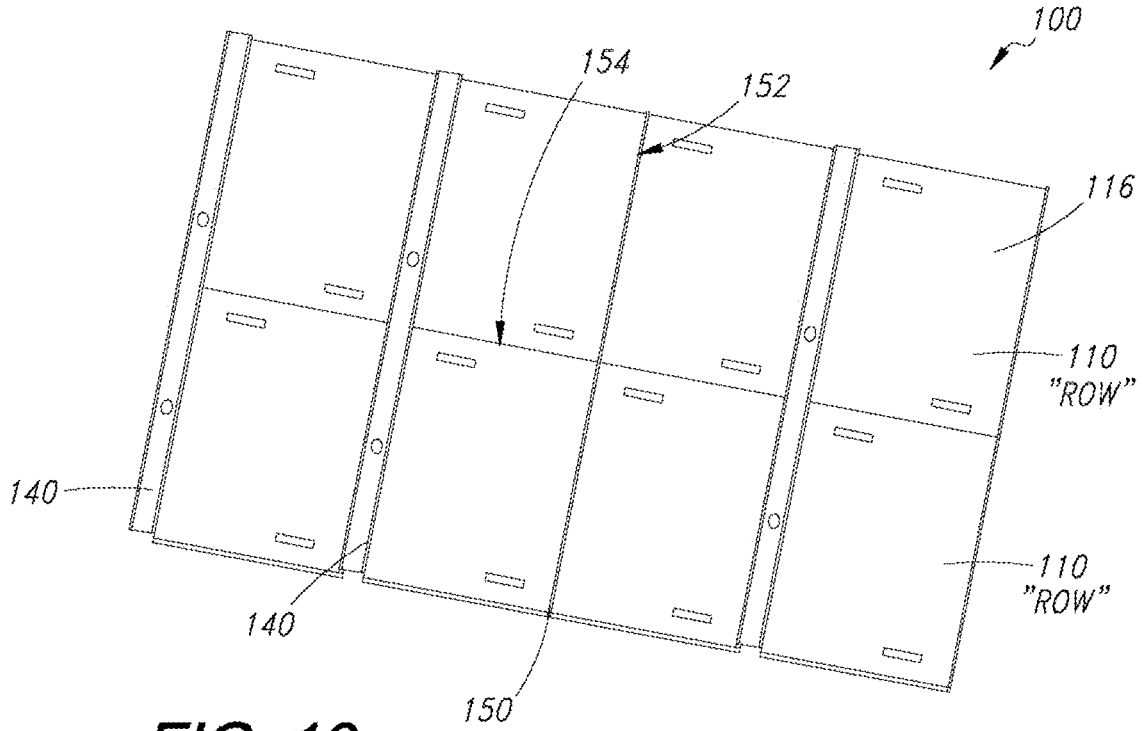
FIG. 13 is a schematic representation of one variation of the ceiling façade system.
Figure 14:
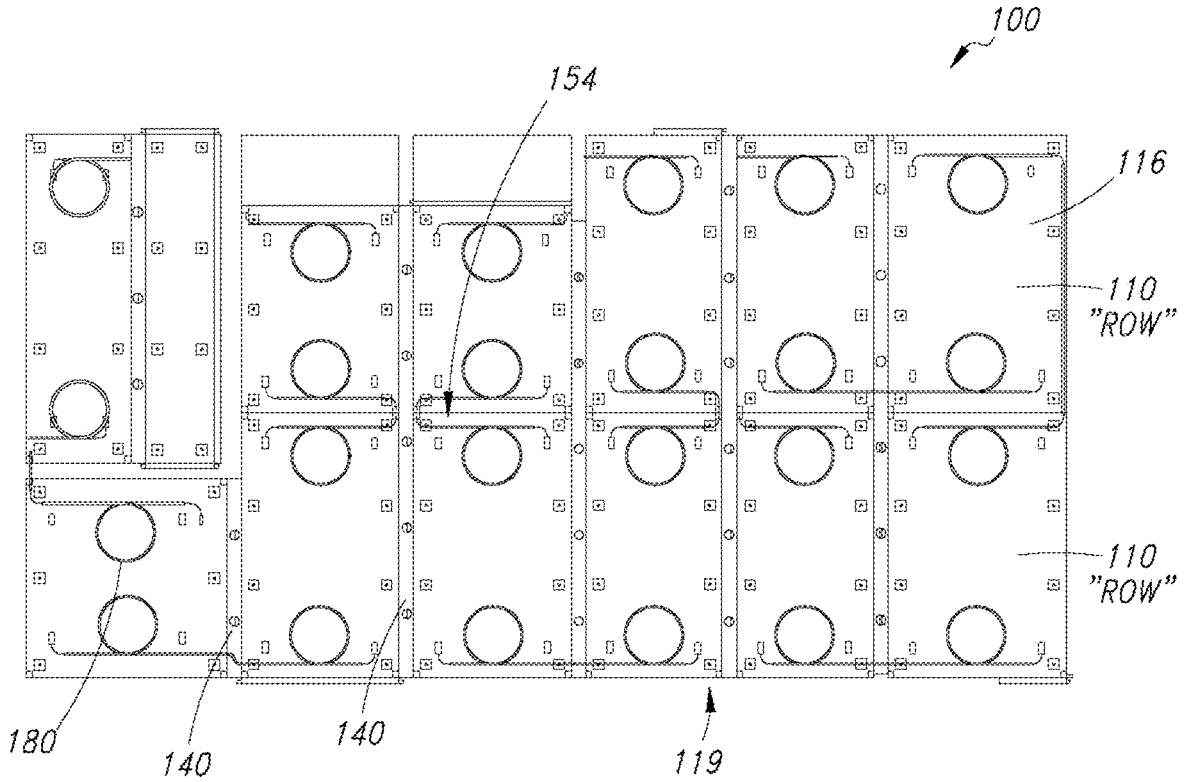
FIG. 14 is a schematic representation of one variation of the ceiling façade system.

The installer may repeat this process to install additional ceiling tiles 110 between this linear lighting and seam track pair in order to complete a first row of ceiling tiles 110 in the ceiling façade system 100. The installer may repeat this process to install additional ceiling tiles 110 between this seam track and an adjacent linear lighting track 140 (or a next linear seam track 160) in order to complete a second row of ceiling tiles 110—abutting the first row of ceiling tiles 110—in the ceiling façade system 100, as shown in FIGS. 12, 13, and 14. The second ends of ceiling tiles 110 in the first and second ceiling tile rows can therefore extend over and fully conceal the linear seam track 160.

8. Ceiling Tile Gap Control

After the installer locates a first row of ceiling tiles 110 between a first linear lighting track 140 and a linear seam track 160 and locates a second row of ceiling tiles 110 between the linear seam track 160 and a second linear lighting track 140, the installer may adjust these ceiling tiles 110: to set longitudinal gaps 154 between third and fourth sides 114 of abutting panels in these ceiling tile rows; to set the lateral positions of these ceiling tiles 110 between the linear lighting and seam tracks; and to set the lateral gap 153 between first and second edges 111, 112 of ceiling tiles 110 abutting at the linear seam track 160 (i.e., the lateral gap 153 between the first and second ceiling tile rows, extending longitudinally along the linear lighting and seam tracks).

8.1 Ceiling Tile Lateral Gap Stops

Generally, a lateral gap 153 between abutting ceiling tiles 110: defines a gap between the second edge of an interior panel 115 of a first ceiling tile 110 and the second edge of an interior panel 115 of a second, abutting ceiling tile 110; falls adjacent the linear seam track 160; and runs parallel to the linear seam track 160, as shown in FIGS. 12, 13, and 14.

In one implementation shown in FIG. 2, the linear seam track 160 can include hard stops 162 (e.g., datums) that engage features on the first and second ceiling tiles 110 to control the lateral gap 153 between the second edges of these ceiling tiles 110. In one example, in the T-profile linear seam track 160 described above, a step between the top flange and a second locating feature 161 of the linear seam track 160 is located laterally on the linear seam track 160 such that the rear flange of the receiver of a ceiling tile 110 engages the step—and is thus constrained laterally—when the second edge of the interior panel 115 of the ceiling tile 110 is parallel and offset from the longitudinal centerline of the linear seam track 160 by half of the target lateral gap 153 width. (In this example, the step can also define an undercut that catches the rear flange of the receiver to prevent the rear flange of the receiver from riding up the step and lifting the ceiling tile 110 when the ceiling tile 110 is driven toward the linear seam track 160, as described below.)

In another example, the spine 163 of the linear seam track 160 extends downwardly from the top flange of the linear seam track 160, and the linear seam track 160 includes a secondary flange that extends laterally from the spine 163 to engage the base of a second receiver 130 of a ceiling tile 110—and thus laterally constrain the ceiling tile 110 relative to the linear seam track 160—when the second edge of the interior panel 115 of the ceiling tile 110 is parallel and offset from the longitudinal centerline of the linear seam track 160 by half of the target lateral gap 153 width.

In yet another example, the spine 163 of the linear seam track 160 defines a thickness equal to a minimum lateral gap 153 and can extend downwardly from the second locating features 161 to engage the second edges of the interior panels 115 of these ceiling tile 110.

Additionally or alternatively, the second receiver 130, the second edge of an interior panel 115, and/or the second edge of a rear panel 116 of a ceiling tile 110 can include tabs, flanges, or other features that extend from the second side 112 of the ceiling tile 110 to mate with the linear seam track 160—and thus laterally constrain the ceiling tile 110 relative to the linear seam track 160—when the second edge of the interior panel 115 of the ceiling tile 110 is parallel and offset from the longitudinal centerline of the linear seam track 160 by half of the target lateral gap 153 width.

Additionally or alternatively, the second receiver 130, the second edge of an interior panel 115, and/or the second edge of a rear panel 116 of a ceiling tile 110 can include tabs, flanges, or other features that extend from the second side 112 of the ceiling tile 110 to mate with the an abutting ceiling tile 110—and thus laterally constrain the ceiling tile 110 relative to the abutting ceiling tile 110—when the second edges of the interior panel 115 of these ceiling tiles 110 are parallel and offset by the target lateral gap 153 width.

8.2 Ceiling Tile Lateral Gap Control

In one implementation shown in FIG. 1, the ceiling façade system 100 includes a spring element 151 (e.g., a coil spring, a flat tension spring) interposed between the first side 111 of a ceiling tile 110 and a linear lighting track 140; and configured to bias the ceiling tile 110 toward the linear seam track 160 to close the lateral gap 153 between the second edge of the ceiling tile 110 and the second edge of an abutting second ceiling tile 110 installed on the opposing side of the linear seam track 160.

For example, as shown in FIG. 1, a linear lighting track 140 can include pairs of spring-loaded detents 151: facing laterally outward from the first return 143 of the linear lighting track 140; offset by less than the length of a ceiling tile 110 (e.g., offset by 40" for a 48"-wide ceiling tile 110); and arranged along the length of the linear lighting track 140 at intervals equal to the length of a ceiling tile 110. In this example, a pair of spring-loaded detents 151 can engage the first receiver 120 of a ceiling tile 110—installed on the linear lighting track 140—and apply a lateral force against the ceiling tile 110 to drive the ceiling tile 110 toward an adjacent linear seam track 160, thereby driving the ceiling tile 110 against datums defined by the linear seam track 160 and locating the second edge of the interior panel 115 of the ceiling tile 110 parallel and offset from the longitudinal centerline of the linear seam track 160 by half of the target lateral gap 153 width. The second linear lighting track 140 on the opposing side of the linear seam track 160 can include similar spring-loaded detents 151 that drive a second ceiling tile 110 toward the linear seam track 160. Therefore, the spring-loaded detents 151 in these linear lighting tracks 140 can automatically locate two ceiling tiles 110—on opposing sides of the linear seam track 160—to set the lateral gap 153 between these two ceiling tiles 110.

Furthermore, in this example, the first receiver 120 of a ceiling tile 110 can include counter-bores or tapered bores configured to receive spring-loaded detents 151 when installed on the linear lighting track 140 such that the spring-loaded detents 151: drive the ceiling tile 110 laterally toward the linear seam track 160; and/or constrain the linear lighting track 140 vertically on the first locating feature 145.

In a similar example, the spring elements described above are integrated into the first side 111 of a ceiling tile 110 and engage the linear lighting track 140 to drive the ceiling tile 110 toward the linear seam track 160.

In another implementation shown in FIG. 7, a linear lighting track 140 can include pairs of threaded bores and set screws 152 (or jack screws): facing laterally outward from the first return 143 of the linear lighting track 140; offset by less than the length of a ceiling tile 110 (e.g., offset by 40" for a 48"-wide ceiling tile 110); and arranged along the length of the linear lighting track 140 at intervals equal to the length of a ceiling tile 110. In this example, once a ceiling tile 110 is installed on the linear lighting track 140, the installer may: reach a tool into the lighting cavity 142 to engage the set screws 152; and tighten the pair of set screws 152 against the first side 111 of the ceiling tile 110 (e.g., against the first receiver 120 of the ceiling tile 110), thereby driving the ceiling tile 110 toward the adjacent linear seam track 160, such as until the second side 112 of the ceiling tile 110 engages a hard stop 162 on the linear seam track 160, thereby locating the second edge of the interior panel 115 of the ceiling tile 110 parallel and offset from the longitudinal centerline of the linear seam track 160 by half of the target lateral gap 153 width. The second linear lighting track 140 on the opposing side of the linear seam track 160 can include similar threaded bores and set screws 152, which the installer may adjust to drive a second ceiling tile 110 toward the linear seam track 160. Therefore, the set screws 152 in these linear lighting tracks 140 can cooperate to locate and lock two ceiling tiles 110 on opposing sides of the linear seam track 160 with their second edges offset by the target lateral gap 153 width.

In a similar example, a linear lighting track 140 can include pairs of through-bores and captured set screws (or jack screws): facing laterally outward from the first return 143 of the linear lighting track 140; offset by less than the length of a ceiling tile 110 (e.g., offset by 40" for a 48"-wide ceiling tile 110); and arranged along the length of the linear lighting track 140 at intervals equal to the length of a ceiling tile 110. In this example, the first side 111 of a ceiling tile 110 (e.g., the first receiver 120 of the ceiling tile 110) includes a set of threaded bores (e.g., riv-nuts) configured to receive a corresponding set of set screws installed on the linear lighting track 140. Thus, once this ceiling tile 110 is installed on the linear lighting track 140, the installer may: screw these set screws into corresponding threaded bores on the first side 111 of the ceiling tile 110. By tightening these set screws, the installer may draw the ceiling tile 110 closer to the linear lighting track 140; by loosening these set screws, the installer may similarly drive the ceiling tile 110 toward the linear seam track 160. These set screws can thus retain the first side 111 of the ceiling tile 110 in vertical, lateral, and longitudinal translation relative to the linear lighting track 140 and maintain the longitudinal and lateral position of the ceiling tile 110 between the linear lighting and seam tracks once set by the installer.

8.3 Longitudinal Ceiling Tile and Wall Gap Control

Generally, a longitudinal gap 154 between abutting ceiling tiles 110 defines a gap: between the third edge of an interior panel 115 of a first ceiling tile 110 and the fourth edge of an interior panel 115 of a second, abutting ceiling tile 110; and runs perpendicular to the linear lighting and seam tracks, as shown in FIGS. 12, 13, and 14.

8.3.1 Hard Stops

In one implementation, the third and/or fourth side 114 of a ceiling tile 110 includes fixed, hard stops configured to mate with features on a fourth side 114 and/or third side 113 of an adjacent ceiling tile 110 to set a longitudinal gap 154 between these ceiling tiles 110. Therefore, to set longitudinal gaps 154 between ceiling tiles 110 within a ceiling tile row, the installer may push all ceiling tiles 110 in this row—along the linear lighting and seam tracks—away from a first wall structure 194 at a first end of the linear lighting and seam tracks and toward a second wall structure 194 at the second end of the linear lighting and seam tracks. The installer may thus force hard stops on the third and/or fourth sides 114 of these ceiling tiles 110 into contact, thereby: closing and setting the longitudinal gaps 154 between these ceiling tiles 110; closing a second gap between the fourth edge of the last ceiling tile 110 in the row and the second wall structure 194 (or an interior wall panel 195 installed on the second wall structure 194); and opening a first gap between the third edge of the first ceiling tile 110 in this row and the first wall structure 194 (or an interior wall panel 195 installed on the first wall structure 194).

In this implementation, interior wall panels 195: can be mounted to and stand off from the wall structure 194, such as described in U.S. patent application Ser. No. 16/875,079; and can extend from the floor of the building 190 up to outer faces 118 of ceiling tiles 110 in the ceiling façade system 100. (For example, the bottom edges of the interior wall panels 195 can be offset above the floor by a reveal height of 0.5", and the top edges of the interior wall panels 195 can be offset below the outer faces 118 of the installed ceiling tiles 110 by a similarly reveal height of 0.25".)

Furthermore, the interior wall panels 195 can be configured to standoff from the wall structure 194 by depths greater than a difference between the length of the building 190 and the minimum assembled length of a row of ceiling tiles 110 designated for this building 190 such that the first and second gaps are fully concealed by interior wall panels 195 installed on the first and second wall structures 194. For example, a set of three 47.5"-long ceiling tiles 110—+/−0.1"—can be installed on 143"-long linear lighting and seam tracks in a 12'-long space with 0.05" longitudinal gaps 154 between adjacent ceiling tiles 110, thereby yielding a minimum ceiling tile row length of 143.15" and a maximum ceiling tile row length of 143.65". An interior wall panel 195 can be configured to install on a wall structure 194 such that the finished interior surface of the interior wall panel 195 is offset from the wall structure 194 by 1.5", thereby concealing a gap between 0.35" and 0.85" at the first end of the ceiling tile row when these ceiling tiles 110 are driven toward the second wall of the building 190 to close the longitudinal gaps 154 between these ceiling tiles 110, as described above.

8.3.2 Spring-Loaded Stops

In another implementation, a ceiling tile 110 can include: a spring element extending from the third side 113 of the ceiling tile 110; and a spring element seat arranged on the fourth side 114 of the ceiling tile 110 opposite the third side 113 of the ceiling tile 110. The spring elements in one ceiling tile 110 can thus mate with the spring element seats on an abutting ceiling tile 110 to set and control the longitudinal gap 154 between these ceiling tiles 110; such spring elements in ceiling tiles 110 in a ceiling tile row can thus cooperate to achieve similar longitudinal gaps 154 between all abutting ceiling tiles 110 in this ceiling tile row when these ceiling tiles 110 are driven together, such as toward one wall structure 194 of the building 190 as described above.

For example, a first ceiling tile 110 can include: a first spring element extending from a third side 113 of the first ceiling tile 110, wherein the third side 113 of the first ceiling tile 110 is perpendicular to the first side 111 and the second side 112 of the first ceiling tile 110; and a first spring element seat arranged on a fourth side 114 of the first ceiling tile 110 opposite the third side 113 of the first ceiling tile 110. A second ceiling tile 110 can: be configured to install between the linear lighting track 140 and the linear seam track 160; and include a second spring element extending from the third side 113 of the second ceiling tile 110 and configured to mate with the first spring element seat on the fourth side 114 of the first ceiling tile 110 to set a first gap between the third side 113 of the second ceiling tile 110 and the fourth side 114 of the first ceiling tile 110. A third ceiling tile 110 can similarly: be configured to install between the linear lighting track 140 and the linear seam track 160; and define a third spring element seat arranged on a fourth side 114 of the third ceiling tile 110 and configured to mate with the first spring element on the third side 113 of the first ceiling tile 110 to set a second gap between the fourth side 114 of the third ceiling tile 110 and the third side 113 of the first ceiling tile 110. Thus, the first spring element and the second spring element can cooperate to maintain a first width of the first gap at approximately a second width of the second gap.

However, the ceiling tiles 110 can include any other hard features or spring-loaded elements configured to control the longitudinal gaps 154 between abutting ceiling tiles 110 in the ceiling tile row.

9. Linear Wall Track

In one variation shown in FIGS. 1, 2, 3, 8, 9, and 10, the ceiling façade system 100 further includes a linear wall track 170 configured to fasten to a wall-parallel to the linear lighting and seam tracks- and to support first or second ends of ceiling tiles 110.

In one implementation, the linear wall track 170 defines a profile approximating a half (e.g., a left bisection) of the linear seam track 160, including a locating feature configured to engage and support a first or second receiver 120, 130 of a ceiling tile 110. In this implementation, the linear wall track 170 can be fastened to the building 190—parallel the linear lighting and seam tracks—near an apex of a wall structure 194 and the ceiling structure 192 with the locating feature of the linear wall track 170 falling within (e.g., within flatness tolerance of 0.05" per linear foot) a plane defined by the first and second locating features 145, 161 of the linear lighting and seam tracks.

Furthermore, like the linear seam track 160, the linear wall track 170 can also include a hard stop (e.g., a datum) configured to laterally locate and constrain the second end of a ceiling tile 110 such that the first edge of the interior panel 115 of the ceiling tile 110 extends over and conceals a first return 143 of a linear lighting track 140 installed adjacent and offset from the linear wall track 170.

However, the linear wall track 170 can define any other geometry and can be installed on the building 190 (e.g., to the ceiling and/or wall structure 194) in any other way.

10. Ceiling Flatness Control

Furthermore, once the linear lighting, seam, and/or wall tracks and the ceiling tiles 110 are installed on the ceiling structure 192 to complete the ceiling façade system 100, the vertical positions of the linear lighting tracks 140 can be adjusted to bring the outer faces 118 of the ceiling tiles 110 into a common plane.

In one example shown in FIG. 1, in the implementation described above in which the linear lighting track 140 includes spring elements 150 and/or set screws configured to bias the base of the body 141 of the linear lighting track 140 off of the ceiling structure 192, the first locating feature 145 of the linear lighting track 140 can be offset—by an offset distance—below the base of the linear lighting track 140 by less than a distance between the second locating feature 161 and the top of the linear seam track 160. In this example, the offset distance can be 0.25", thereby enabling the installer to adjust the vertical position of the linear lighting track 140 to accommodate for as much as 0.25" deviation in flatness of the ceiling structure 192 between the installed locations of the linear lighting track 140 and the adjacent linear seam track 160 by tightening the linear lighting track 140 against the ceiling structure 192.

Therefore, in this example, the installer may insert a tool into the lighting cavity 142 of a linear lighting track 140, engage these fasteners with the tool, and thus adjust these fasteners to raise and/or lower sections of this linear lighting track 140 to bring outer faces 118 of rows of ceiling tiles 110 on each side of the linear lighting track 140 into a common plane and to bring outer faces 118 of rows of ceiling tiles 110 on each side of an adjacent linear seam track 160 into this plane.

In this variation, the linear wall track 170 can be similarly mounted to the ceiling structure 192; and the installer may implement similar methods to adjust the vertical position of the linear wall track 170 in order to achieve a consistent, target gap between: the outer faces 118 of ceiling tiles 110 installed along this linear wall track 170; and the top edges of wall panels 195 installed on the adjacent wall structure 194.

11. Other Track Patterns

In one variation, for an installation with low lighting requirements, the installer may install linear lighting tracks 140 and linear seam tracks 160 in a lighting-seam-seam-lighting-seam-seam track pattern. In this variation, the installer may offset a linear seam track 160 from an adjacent linear seam track 160 by a lateral center-to-center distance approximately equal to: the width of a ceiling tile 110 (e.g., 4'); less half a target gap width between the second edge of ceiling tiles 110 abutting at the linear seam track 160 (e.g., 0.125").

In yet another variation shown in FIG. 13, for an installation with high lighting requirements, the installer may install linear lighting tracks 140 and linear seam tracks 160 in a lighting-lighting-seam track pattern. In this variation, the installer may offset a linear lighting track 140 from an adjacent linear lighting track 140 by a lateral center-to-center distance approximately equal to: the sum of the width of a ceiling tile 110 (e.g., 4') and the width of the light cavities of the linear lighting tracks 140 (e.g., 6"); less twice a minimum overlap distance of the first edge of the interior panel 115 of the ceiling tile 110 into the lighting cavity 142 of the linear lighting track 140 (e.g., 0.25").

11.1 Ceiling Tile Installation Between Linear Lighting Track Pair

After the installer locates a row of ceiling tiles 110 between two linear lighting tracks 140, the installer may adjust these ceiling tiles 110 to set longitudinal gaps 154 between third and fourth sides 114 of abutting panels and to set the lateral positions of these ceiling tiles 110 between the linear lighting tracks 140.

In one implementation as described above, the ceiling façade system 100 includes: a first set of spring elements located between the first linear lighting track 140 and the first side 111 of a ceiling tile 110; and a second set of spring elements located between the second linear lighting track 140 and the second side 112 of the ceiling tile 110. In this implementation, the first and second sets of spring elements are balanced (i.e., define similar spring element constants and are located in positions mirrored across the ceiling tile 110 or between the linear lighting tracks 140) and apply forces toward the lateral center of the ceiling tile 110. Thus, when the forces applied laterally across the ceiling tile 110 by these spring elements equilibrate, these spring elements can automatically center the ceiling tile 110 laterally between the first and second linear lighting tracks 140.

In another implementation, the ceiling façade system 100 includes: a first row of set screws located between the first linear lighting track 140 and the first side 111 of the ceiling tile 110 (e.g., threaded through bores in the first return 143 of the body 141 of the first linear lighting track 140); and a second row of set screws located between the second linear lighting track 140 and the second side 112 of the ceiling tile 110 (e.g., threaded through bores in the second return 144 of the body 141 of the second linear lighting track 140). In this implementation, the installer may adjust the first and second rows of set screws against the first and second sides 111, 112 (e.g., the first and second receivers 120, 130) of the ceiling tile 110, respectively, to adjust the lateral position of the ceiling tile 110 and to mechanically lock the ceiling tile 110 between the first and second linear lighting tracks 140.

11.2 Ceiling Tile Installation Between Linear Seam Track Pair

Similarly, after the installer locates a row of ceiling tiles 110 between two linear seam tracks 160, the installer may adjust these ceiling tiles 110 to set longitudinal gaps 154 between third and fourth sides 114 of abutting panels and to set the lateral positions of these ceiling tiles 110 between the linear lighting tracks 140.

In one implementation, linear seam tracks 160 configured to install immediately adjacent other linear seam tracks 160 (e.g., linear seam tracks 160 in a lighting-seam-seam-lighting pattern or in a lighting-seam-seam-seam-lighting pattern) can exclude longitudinal datums configured to set lateral gaps 153 between rows of ceiling tiles 110 that abut at these linear seam tracks 160, as described above. Rather, a ceiling tile 110 configured to abut another ceiling tile 110 over a linear seam track 160 in a lighting-seam-seam-lighting pattern or in a lighting-seam-seam-seam-lighting pattern can include integrated datums (e.g., "standoffs) configured to set the lateral gap 153 between the second edge of the ceiling tile 110 to the second edge of an abutting ceiling tile 110.

Thus, in this implementation, once the installer places three rows of ceiling tiles 110 between linear lighting and seam tracks in a lighting-seam-seam-lighting pattern, the installer may adjust set screws in the linear lighting tracks 140: to force the abutting edges of ceiling tiles 110 in the rows together over the two linear seam tracks 160; and to achieve similar overlapping of the first edges of ceiling tiles 110 in the first and third rows of ceiling tiles 110 over the first returns 143 of the first and second linear lighting tracks 140, respectively. Alternatively, balanced spring elements in these linear lighting tracks 140 can drive these three rows of ceiling tiles 110 together: to automatically force the abutting edges of ceiling tiles 110 in the rows together over the two linear seam tracks 160; and to automatically achieve similar overlapping of the first edges of ceiling tiles 110 in the first and third rows of ceiling tiles 110 over the first returns 143 of the first and second linear lighting tracks 140, respectively.

The installer may similarly set gaps between ceiling tiles 110 in four rows of ceiling tiles 110 between linear lighting and seam tracks in a lighting-seam-seam-seam-lighting pattern.

12. Heating-Enabled Ceiling Tile

In one variation shown in FIGS. 1, 2, and 6A, a ceiling tile 110 includes: an interior panel 115 defining an outer face 118, an inner face, a first edge extending along a first side 111 of the ceiling tile 110, and a second edge extending along a second side 112 of the ceiling tile 110 opposite the first edge; a heating element 180 arranged across the inner face of the interior panel 115; an insulator layer 117 arranged over the heating element 180 opposite the interior panel 115; and a rear panel 116 arranged over the insulator layer 117 opposite the interior panel 115. Generally, in this variation, the ceiling tile 110 includes an integrated heating element 180 configured to conductively heat the interior panel 115 of the ceiling tile 110, thereby heating the space 191 below via convection and/or radiation. Thus, in this variation: the linear lighting track 140 can include integrated lighting, sensing, and/or fire-suppression services; the ceiling tiles 110 can define finished ceiling surfaces; and all or a subset of ceiling tiles 110 installed on a ceiling structure 192 can include integrated heating services.

In this variation, the heating element 180 can be arranged across and potted against the inner face of the interior panel 115; and the insulator layer 117 can include a structural foam cast in situ between the interior panel 115 and the rear panel 116 of the ceiling tile 110 such that the heating element 180 is potted against the inner face of the interior panel 115 and encapsulated by the expanding foam of the insulator layer 117.

Additionally or alternatively, the heating element 180 can be clamped, bonded, or fastened directly to the interior panel 115 of the ceiling tile 110. For example, the ceiling tile 110 can include sheetmetal brackets arranged at intervals along the heating element 180 and spot-welded to the inner face of the interior panel 115. In another example, the heating element 180 can be bonded to the inner face of the interior panel 115 with an adhesive, and a precast insulator layer 117 and rear panel 116 assembly can be arranged over and boned to the heating element 180 and the interior panel 115 to complete the ceiling tile 110.

However, in this variation, the heating element 180 can be assembled in the ceiling tile 110 in any other way.

12.1 Electric Heating

In one implementation shown in FIG. 1, the heating element 180 includes an electric resistance heating coil. In this implementation, the ceiling tile 110 can further include an electrical connector (e.g., a two-pronged quick-connect plug): extending from the ceiling tile 110 opposite the interior panel 115; configured to transiently couple to an electrical receptacle arranged on the ceiling structure 192; and configured to supply current from the electrical receptacle to the heating element 180 to heat the interior panel 115 of the ceiling tile 110. Thus, when the ceiling tile 110 is installed between linear lighting and seam tracks on the ceiling structure 192, the electrical connector can be quickly connected to the switched electrical receptacle, which selectively supplies current to the heating element 180 to heat the panel and thus the space below.

12.2 Fluid-Based Heating

In another implementation shown in FIGS. 2 and 14, the heating element 180 of the ceiling tile 110 includes a fluid line, such as hard copper pipe or flexible cross-linked polyethylene tubing. In this implementation, the ceiling tile 110 can further include a fluid supply connector 182: extending from the ceiling tile 110 opposite the interior panel 115; configured to transiently couple to an outlet of a fluid supply manifold arranged on the ceiling structure 192 (or an outlet port arranged on an adjacent heating-enabled ceiling tile 110); and configured to supply heated fluid (e.g., water) from the outlet of the fluid supply manifold (or the outlet port) to the fluid line to heat the interior panel 115 of the ceiling tile 110.

In this implementation, the ceiling tile 110 can similarly include a fluid return connector 184 configured to return fluid exiting the fluid heat. For example, the fluid return connector 184 can include a flexible fluid line with a quick-connect coupler configured to connect to a fluid return manifold on the ceiling. Thus, in this example: heated fluid flows from a fluid supply manifold in the ceiling in the heating element 180 via the fluid supply connector 182; this fluid heats the ceiling tile 110 via the heating element 180; cooled fluid returns to the fluid return manifold via the fluid return connector 184; and this cooled fluid is pumped back to a heater—in or adjacent the building 190—which heats this fluid before a pump returns this heated fluid to the fluid supply manifold.

Alternatively, the fluid return connector 184 can include a return port: arranged on the rear panel 116 of the ceiling tile 110; configured to couple to a second fluid supply connector 182 of a second, adjacent ceiling tile 110 in the ceiling façade system 100; and configured to supply (heated) fluid to the second ceiling tile 110 via the second fluid supply connector 182. For example, a fluid supply manifold and a fluid return manifold can be arranged over a heating "zone" in the space 191, and a group of ceiling tiles 110 over this zone can be connected in series between this fluid supply manifold and a fluid return manifold. Similar fluid supply manifold, fluid return manifold, and ceiling tile 110 assemblies can be installed and connected over other heating zones within the space 191.

Therefore, in this implementation, when the ceiling tile 110 is installed between linear lighting and seam tracks on the ceiling structure 192: the fluid supply connector 182 can be quickly connected to the fluid supply manifold and/or to a return port on an adjacent ceiling tile 110; and the fluid return connector 184 or return port can be quickly connected to the fluid return manifold and/or to a fluid supply connected on an adjacent ceiling tile 110, thereby enabling the installer to quickly connect and complete heating services in the building 190.

In this implementation, cooled fluid (e.g., water, refrigerant) can be similarly pumped through the fluid line to cool the ceiling tile 110. Furthermore, in this variation, both an electric resistance heating coil and a fluid line can be integrated into the ceiling tile 110 to enable both heating and cooling of the ceiling tile 110.

12.3 Forced Air in Ceiling Cavity

In this variation, to increase the rate of heat transfer between air in the building 190 and installed ceiling tiles 110, the ceiling façade system 100 can include a fan or blower: configured to install in or couple to the ceiling cavity 193 between the ceiling structure 192 and these ceiling tiles 110; and configured to pressurize the ceiling cavity 193, thereby forcing air to flow across the rear faces of the ceiling tiles 110 and through gaps between the ceiling tiles 110, thereby increasing heat transfer between these ceiling tiles 110 and this air, which may then flow downward to condition the space 191 below the ceiling façade system 100.

In this implementation, the linear lighting tracks 140 can additionally or alternatively include: ventilation ports 147 that intake air from the ceiling cavity 193; and a baffle 148 that directs this air laterally across the outer faces 118 of the adjacent ceiling tiles 110, thereby increasing heat transfer between the outer faces 118 of these ceiling tiles 110 and this air.

Additionally or alternatively, in this implementation, the ceiling tile 110 can include: a ventilation port 147 passing (vertically) from the rear panel 116 to the interior panel 115 of the ceiling tile 110; and a fan or other blower element arranged across the ventilation port 147 and configured to move air between the ceiling cavity 193 and the space 191 below in order to increase heat transfer between the ceiling tile 110 and air in the space 191 when the heating element 180 is active and in order to move air throughout the space 191 when the heating element 180 is inactive. In this implementation, the ceiling tile 110 can include a quick-connect electrical connector configured: to connect to a switch electrical receptacle on the ceiling structure 192 (or on an electrical receptacle an adjacent ceiling tile 110); and to supply power to this integrated fan.

12.4 Forced Air Through Linear Lighting Track

Additionally or alternatively, the linear lighting tracks 140 can include: a ventilation port 147 configured to couple to a forced-air heating system within the building 190; and a baffle 148 arranged in the linear lighting track 140 and configured to distribute conditioned air—entering the linear lighting track 140 via the ventilation port 147—along a portion of the length of the linear lighting track 140.

13. Window Shade

Figure 11:
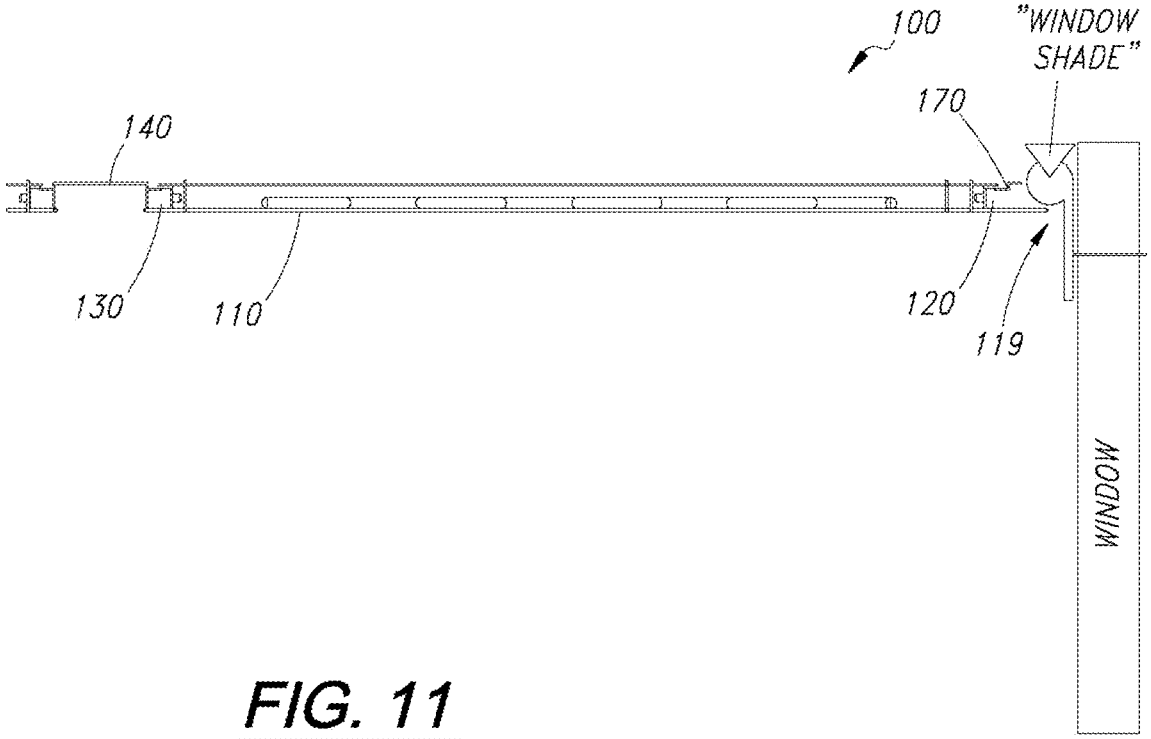
FIG. 11 is a schematic representation of one variation of the ceiling façade system.

Furthermore, in one variation shown in FIGS. 11 and 14, a ceiling tile 110 designated for installation adjacent a window includes a shade recess 119: that runs along the window when the ceiling tile 110 is installed; and configured to surround an electromechanical window shade. In this implementation, the electromechanical window shade can be installed on the ceiling structure 192 and adjacent the window and can sit in an apex between the ceiling structure 192 and a short wall structure 194 above the window. The linear wall track 170 can be installed on the ceiling structure 192 along the electromechanical window shade opposite the window. The first or second receiver 120, 130 of the ceiling tile 110 can be installed on the linear wall track 170 and can conceal the electromechanical window shade when retracted, but the shade recess 119 enables the shade to drop to shade the adjacent window.

The ceiling facade system 100 can similarly include a ceiling tile 110: designated for installation adjacent a window or between two interior spaces; and including a recess configured to receive a curtain configured to move laterally along a ceiling-mounted or tile-mounted curtain track to cover the adjacent window or to separate the two interior spaces.

As a person skilled in the art will recognize from the previous detailed description and from the figures and claims, modifications and changes can be made to the embodiments of the invention without departing from the scope of this invention as defined in the following claims.

We claim:

1. A system comprising:

a linear lighting track comprising a locating feature extending laterally from the linear lighting track; and a first ceiling tile configured to install adjacent the linear lighting track and comprising:

a rear panel configured to face a ceiling cavity;

an interior panel:

coupled to and offset from the rear panel; and defining:

an inner surface facing the rear panel;

an outer surface facing opposite the inner surface; and a first edge extending along a first side of the first ceiling tile;

a heating element:

interposed between the interior panel and the rear panel; and configured to heat the interior panel, the interior panel configured to heat a space located below the ceiling cavity via convection;

an insulator layer:

interposed between the interior panel and the rear panel; and configured to:

insulate the rear panel from the heating element and to insulate the space from the ceiling cavity; and insulate the heating element from the linear lighting track to prevent thermal transfer from the heating element to the linear lighting track; and a receiver configured to locate the first edge of the interior panel adjacent the locating feature of the linear lighting track to partially conceal the linear lighting track.

2. The system of claim 1, wherein the linear lighting track comprises a vent configured to:

draw ambient air from the ceiling cavity across the first ceiling tile to transfer heat from the first ceiling tile to ambient air; and direct heated air toward the space located below the ceiling cavity.

3. The system of claim 1:

wherein the heating element is interposed between the inner surface of the interior panel and the insulator layer; and wherein the insulator layer is arranged over the heating element opposite the interior panel and configured to:

retain the heating element against the inner surface of the interior panel to conductively heat the interior panel; and insulate the interior panel and the heating element from the rear panel to retain heat below the ceiling cavity.

4. The system of claim 1:

wherein the heating element comprises a fluid line interposed between the interior panel and the rear panel; and wherein the first ceiling tile further comprises:

a fluid supply connector:

arranged behind the interior panel; and configured to supply heated fluid from a fluid supply, arranged within the ceiling cavity, to the fluid line to heat the interior panel; and a fluid return connector:

arranged behind the interior panel; and configured to return fluid exiting the fluid line.

5. The system of claim 4:

wherein the fluid return connector comprises a return port arranged on the first ceiling tile opposite the interior panel; and further comprising:

a second ceiling tile:

configured to install adjacent the first ceiling tile; and comprising:

a second fluid line; and a second fluid supply connector:

configured to transiently couple to the return port of the first ceiling tile; and configured to supply heated fluid from the first ceiling tile, via the return port, to the second fluid line to heat the second ceiling tile.

6. The system of claim 1, wherein the first ceiling tile further comprises:

an electrical connector:

arranged behind the interior panel; and configured to supply electrical current from a power supply, arranged within the ceiling cavity, to the heating element to heat the interior panel, the interior panel configured to heat the space located below the ceiling cavity via convection;

a fluid line interposed between the interior panel and the rear panel;

a fluid supply connector:

arranged on the first ceiling tile opposite the interior panel; and configured to supply cooled fluid from a fluid supply, arranged within the ceiling cavity, to the fluid line to cool the interior panel, the interior panel configured to cool the space located below the ceiling cavity via convection; and a fluid return connector:

arranged on the first ceiling tile opposite the interior panel; and configured to return fluid exiting the fluid line.

7. The system of claim 6, wherein the fluid supply connector is configured to selectively:

supply heated fluid from the fluid supply to the fluid line to heat the interior panel at a first time; and supply cooled fluid from the fluid supply to the fluid line to cool the interior panel at a second time.

8. The system of claim 1:

wherein the heating element comprises a fluid line interposed between the interior panel and the rear panel;

wherein the first ceiling tile further comprises:

a fluid supply connector configured to supply heated fluid from a fluid supply manifold, arranged within the ceiling cavity, to the fluid line to heat the interior panel; and further comprising:

a sprayer:

arranged on the linear lighting track; and fluidly coupled to the fluid supply manifold; and configured to supply fluid from the fluid supply manifold into the space located below the ceiling cavity for fire suppression.

9. The system of claim 1:

further comprising a linear seam track configured to install adjacent the first ceiling tile;

wherein the first ceiling tile is configured to mount to the linear seam track to partially conceal the linear seam track; and wherein the insulator layer is configured to insulate the heating element from the linear seam track to prevent thermal transfer from the heating element to the linear seam track.

10. The system of claim 1:

wherein the linear lighting track is configured to bias downward from the ceiling cavity to:

offset the locating feature below the ceiling cavity; and locate the outer surface of the interior panel of the first ceiling tile coplanar with outer surfaces of interior panels of adjacent ceiling tiles.

11. A system comprising:

a linear lighting track:

configured to locate on a ceiling structure;

defining a lighting cavity facing downwardly from the ceiling structure; and comprising:

a first locating feature extending from the linear lighting track opposite the lighting cavity; and a second locating feature extending from the linear lighting track opposite the first locating feature;

a first ceiling tile:

comprising:

a first interior panel defining a first edge extending along a first side of the first ceiling tile; and a first insulator layer arranged proximal the first interior panel; and a first receiver configured to support the first side of the first ceiling tile on the first locating feature of the linear lighting track; and configured to mount to the linear lighting track proximal the first edge; and a second ceiling tile:

comprising:

a second interior panel defining a second edge extending along a second side of the second ceiling tile;

a second insulator layer arranged proximal the second interior panel; and a second receiver support the second side of the second ceiling tile on the second locating feature of the linear lighting track; and configured to:

mount to the linear lighting track proximal the second edge to install adjacent and laterally offset from the first ceiling tile; and bias toward the linear lighting track to close a gap between the first edge of the first ceiling tile and the second edge of the second ceiling tile.

12. The system of claim 11:

wherein the first ceiling tile comprises:

a first fluid line;

a first fluid supply connector configured to supply fluid from a fluid supply to the first fluid line; and a first fluid return connector configured to return fluid exiting the first fluid line; and wherein the second ceiling tile comprises:

a second fluid line; and a second fluid supply connector configured to:

transiently couple to the first fluid return connector of the first ceiling tile; and supply fluid from the first fluid line, via the first fluid return connector, to the second fluid line.

13. The system of claim 12, wherein the second fluid supply connector is configured to:

supply cooled fluid from the first fluid line, via the first fluid return connector, to the second fluid line to cool the second interior panel at a first time; and supply heated fluid from the first fluid line, via the first fluid return connector, to the second fluid line to heat the second interior panel at a second time.

14. The system of claim 11:

wherein the first ceiling tile comprises a heating element:

interposed between the first interior panel and the first insulator layer; and configured to heat the first interior panel, the first interior panel configured to heat a space located below the ceiling structure via convection; and wherein the second ceiling tile comprises a cooling element:

interposed between the second interior panel and the second insulator layer; and configured to cool the second interior panel, the second interior panel configured to cool the space located below the ceiling structure via convection.

15. The system of claim 11:

wherein the first ceiling tile comprises a first heating element:

interposed between the first interior panel and the first insulator layer; and configured to heat the first interior panel, the first interior panel configured to heat a space located below the ceiling structure via convection; and wherein the first insulator layer is configured to insulate the space from the ceiling structure.

16. The system of claim 11:

wherein the first ceiling tile further comprises:

a first rear panel offset above the first interior panel; and a heating element interposed between the first interior panel and the first rear panel; and wherein the first insulator layer comprises a structural foam:

arranged between the first interior panel and the first rear panel of the first ceiling tile; and configured to insulate the first rear panel from the heating element.

17. A system comprising:

a first ceiling tile comprising:

a rear panel configured to face a ceiling cavity;

an interior panel:

coupled to and offset from the rear panel; and defining:

an inner surface facing the rear panel; and an outer surface facing opposite the inner surface; and a heating element:

interposed between the interior panel and the rear panel; and configured to heat the interior panel;

a second ceiling tile configured to install adjacent and laterally offset from the first ceiling tile; and a blower configured to:

install within the ceiling cavity; and direct ambient air from the ceiling cavity across the first ceiling tile to transfer heat from the first ceiling tile to ambient air; and direct heated air through a gap, formed between the first ceiling tile and the second ceiling tile, toward a space located below the ceiling cavity via convection.

18. A system comprising:

a ceiling tile comprising:

a rear panel configured to face a ceiling cavity;

an interior panel:

coupled to and offset from the rear panel; and defining:

an inner surface facing the rear panel;

an outer surface facing opposite the inner surface; and a first edge extending along a first side of the ceiling tile;

a heating element:

interposed between the interior panel and the rear panel; and configured to heat the interior panel, the interior panel configured to heat a space located below the ceiling cavity via convection;

an insulator layer:

interposed between the interior panel and the rear panel; and configured to insulate the rear panel from the heating element and to insulate the space from the ceiling cavity; and a receiver configured to locate the interior panel adjacent a locating feature of a linear lighting track to partially conceal the linear lighting track; and the linear lighting track:

configured to install adjacent the ceiling tile;

insulated from the heating element via the insulator layer of the ceiling tile; and comprising:

the locating feature extending laterally from the linear lighting track; and a vent configured to:
draw ambient air from the ceiling cavity across the ceiling tile to transfer heat from the ceiling tile to ambient air; and
direct heated air toward the space located below the ceiling cavity.

19. A ceiling tile comprising:
a rear panel configured to face a ceiling cavity;
an interior panel:
coupled to and offset from the rear panel; and
defining:
an inner surface facing the rear panel; and
an outer surface facing opposite the inner surface;
a heating element:
interposed between the interior panel and the rear panel; and
configured to heat the interior panel, the interior panel configured to heat a space located below the ceiling cavity via convection at a first time;
an insulator layer:
interposed between the interior panel and the rear panel; and
configured to insulate the rear panel from the heating element and to insulate a space located below the ceiling cavity from the ceiling cavity;
an electrical connector:
arranged behind the interior panel; and
configured to supply electrical current from a power supply, arranged within the ceiling cavity, to the heating element to heat the interior panel, the interior panel configured to heat the space located below the ceiling cavity via convection;
a fluid line interposed between the interior panel and the rear panel;
a fluid supply connector:
arranged on the ceiling tile opposite the interior panel; and
configured to supply cooled fluid from a fluid supply, arranged within the ceiling cavity, to the fluid line to cool the interior panel, the interior panel configured to cool the space located below the ceiling cavity via convection at a second time; and
a fluid return connector:
arranged on the ceiling tile opposite the interior panel; and
configured to return fluid exiting the fluid line.

20. A ceiling tile comprising:
a rear panel configured to face a ceiling cavity;
an interior panel:
coupled to and offset from the rear panel; and
defining:
an inner surface facing the rear panel; and
an outer surface facing opposite the inner surface;
a heating element interposed between the interior panel and the rear panel;)
an insulator layer:
interposed between the interior panel and the rear panel; and
configured to insulate the rear panel from the heating element and to insulate a space located below the ceiling cavity from the ceiling cavity;
an electrical connector:
arranged behind the interior panel; and
configured to supply electrical current from a power supply, arranged within the ceiling cavity, to the heating element to heat the interior panel, the interior panel configured to heat the space located below the ceiling cavity via convection;
a fluid line interposed between the interior panel and the rear panel;
a fluid supply connector:
arranged on the ceiling tile opposite the interior panel; and
configured to supply heated fluid from a fluid supply, arranged within the ceiling cavity, to the fluid line to heat the interior panel, the interior panel configured to heat a space located below the ceiling cavity via convection at a first time; and
configured to supply cooled fluid from the fluid supply to the fluid line to cool the interior panel, the interior panel configured to cool the space located below the ceiling cavity via convection at a second time; and
a fluid return connector:
arranged on the ceiling tile opposite the interior panel; and
configured to return fluid exiting the fluid line.

21. A system comprising:
a ceiling tile comprising:
a rear panel configured to face a ceiling cavity;
an interior panel:
coupled to and offset from the rear panel; and
defining:
an inner surface facing the rear panel; and
an outer surface facing opposite the inner surface;
a heating element:
comprising a fluid line interposed between the interior panel and the rear panel; and
configured to heat the interior panel, the interior panel configured to heat a space located below the ceiling cavity via convection;
an insulator layer:
interposed between the interior panel and the rear panel; and
configured to insulate the rear panel from the heating element and to insulate the space from the ceiling cavity; and
a fluid supply connector configured to supply heated fluid from a fluid supply manifold, arranged within the ceiling cavity, to the fluid line to heat the interior panel; and
a sprayer:
arranged proximal the ceiling tile;
fluidly coupled to the fluid supply manifold; and
configured to supply fluid from the fluid supply manifold into the space located below the ceiling cavity for fire suppression.

* * * * *